US011296456B2

(12) United States Patent
Takagi et al.

(10) Patent No.: US 11,296,456 B2
(45) Date of Patent: Apr. 5, 2022

(54) ELECTRICAL CONNECTOR WITH SHIELD SHELL FOR CONNECTING TO CASE

(71) Applicant: Yazaki Corporation, Tokyo (JP)

(72) Inventors: Akiyoshi Takagi, Shizuoka (JP); Ayumu Ishikawa, Shizuoka (JP); Junichi Tatsumi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/009,786

(22) Filed: Sep. 2, 2020

(65) Prior Publication Data

US 2021/0066849 A1 Mar. 4, 2021

(30) Foreign Application Priority Data

Sep. 3, 2019 (JP) ..... JP2019-160483

(51) Int. Cl.

| | |
|---|---|
| ***H01R 13/60*** | (2006.01) |
| ***H01R 13/516*** | (2006.01) |
| ***H01R 13/52*** | (2006.01) |
| ***H01R 13/6581*** | (2011.01) |
| ***H01R 43/18*** | (2006.01) |
| *H01R 13/74* | (2006.01) |

(Continued)

(52) U.S. Cl.

CPC ..... *H01R 13/60* (2013.01); *H01R 13/516* (2013.01); *H01R 13/5219* (2013.01);

(Continued)

(58) Field of Classification Search

CPC .. H01R 13/60; H01R 13/516; H01R 13/5219; H01R 13/6581; H01R 43/18;

(Continued)

(56) References Cited

U.S. PATENT DOCUMENTS 3,200,355 A * 8/1965 Dahlen ..... H01R 13/7197 333/183
5,670,998 A * 9/1997 Shimoda ..... B41J 2/01 174/51

(Continued)

FOREIGN PATENT DOCUMENTS

EP 2 056 412 A2 5/2009
EP 2056412 A2 * 5/2009 ..... H01R 13/5216

(Continued)

*Primary Examiner* — Abdullah A Riyami
*Assistant Examiner* — Justin M Kratt
(74) *Attorney, Agent, or Firm* — Kenealy Vaidya LLP

(57) ABSTRACT

A connector includes: a terminal metal fitting that is connected to an electric wire and is configured to be inserted into a connector insertion hole of a metal case of a counterpart device from an opening; a housing includes a connector insertion part configured to be inserted into the connector insertion hole from the opening together with the terminal metal fitting; a liquid seal member that is configured to seal a gap between the housing and a rim of the opening in the case; a shield shell that includes a cylindrical accommodation body accommodating the housing therein, an annular flange configured to be opposed to an annular surface around the rim of the opening in the case, and a fixed part configured to be fixed to the case; and an annular interposed member that is configured to be interposed between the flange and the annular surface to be sandwiched therebetween.

4 Claims, 18 Drawing Sheets

(51) Int. Cl.

| | |
|---|---|
| *H01R 13/533* | (2006.01) |
| *H01R 13/6596* | (2011.01) |
| *H01R 24/76* | (2011.01) |
| *H01R 24/28* | (2011.01) |
| *H01R 13/6583* | (2011.01) |

(52) U.S. Cl.
CPC ..... *H01R 13/6581* (2013.01); *H01R 43/18* (2013.01); *H01R 13/5202* (2013.01); *H01R 13/533* (2013.01); *H01R 13/6583* (2013.01); *H01R 13/6596* (2013.01); *H01R 13/748* (2013.01); *H01R 24/28* (2013.01); *H01R 24/76* (2013.01)

(58) Field of Classification Search
CPC ..... H01R 13/6583; H01R 13/748; H01R 13/6596; H01R 13/5202; H01R 13/533; H01R 24/28; H01R 24/76
See application file for complete search history.

(56) References Cited

U.S. PATENT DOCUMENTS

| | | | | |
|---|---|---|---|---|
| 2010/0046189 | A1* | 2/2010 | Hasegawa ..... | H01R 13/6593 361/816 |
| 2014/0120763 | A1* | 5/2014 | Itsuki ..... | H01R 13/533 439/382 |
| 2014/0120767 | A1* | 5/2014 | Itsuki ..... | H01R 13/5202 439/587 |
| 2015/0144396 | A1 | 5/2015 | Tanaka | |
| 2017/0093094 | A1 | 3/2017 | Mukuno et al. | |

FOREIGN PATENT DOCUMENTS

| | | | |
|---|---|---|---|
| JP | 2004-31233 | A | 1/2004 |
| JP | 2007-335379 | A | 12/2007 |
| JP | 2011-60452 | A | 3/2011 |
| JP | 2015-103500 | A | 6/2015 |

* cited by examiner

ELECTRICAL CONNECTOR WITH SHIELD SHELL FOR CONNECTING TO CASE

CROSS-REFERENCE TO RELATED APPLICATION(S)

The present application claims priority to and incorporates by reference the entire contents of Japanese Patent Application No. 2019-160483 filed in Japan on Sep. 3, 2019.

BACKGROUND OF THE INVENTION

1. Field of the Invention

The present invention relates to a connector.

2. Description of the Related Art

A conventional connector is enclosed from the outside by a shield shell made of a conductive metal material so as to prevent noise intrusion into the connector. The connector physically and electrically connects its terminal metal fitting to a counterpart terminal metal fitting of a counterpart device, and fixes the shield shell to a case of the counterpart device using a fixture such as a screw so as to maintain the connection state. This type of connector is disclosed in, for example, Japanese Patent Application Laid-open No. 2015-103500.

For the counterpart device, the case is also formed from a conductive metal material so as to prevent noise intrusion into the device. The case and the shield shell are not always formed from metal materials having ionization tendencies equal or substantially equal to each other. Typically, when metals in contact with each other have different ionization tendencies from each other, a larger potential difference resulting from the difference in ionization tendency may increase a possibility of reducing durability depending on their usage environment. Thus, the conventional connector has room for improvement in improving its durability and the durability of the counterpart device.

SUMMARY OF THE INVENTION

It is an object of the present invention to provide a connector capable of improving its durability.

In order to achieve the above mentioned object, a connector according to one aspect of the present invention includes a terminal metal fitting that is physically and electrically connected to an end of an electric wire and is configured to be inserted into a connector insertion hole of a metal case of a counterpart device from an opening of the connector insertion hole and physically and to be electrically connected to a counterpart terminal metal fitting of the counterpart device; a housing serving as an accommodation member made of an insulating material that accommodates the terminal metal fitting and the electric wire and leads the electric wire out of the housing, and includes a connector insertion part configured to be inserted into the connector insertion hole from the opening together with the terminal metal fitting; a liquid seal member that is configured to seal a gap between the housing and a rim of the opening in the case; a shield shell that is made of a metal material and includes a cylindrical accommodation body accommodating the housing therein, an annular flange configured to be opposed to an annular surface around the rim of the opening in an outer wall surface of the case, and a fixed part configured to be fixed to the case; and an annular interposed member that is made of a resin material and is configured to be interposed between the flange and the annular surface to be sandwiched between the flange and the annular surface.

According to another aspect of the present invention, in the connector, it is possible to configure that the interposed member is formed from a conductive rubber material.

According to still another aspect of the present invention, in the connector, it is possible to configure that the fixed part includes a collar member configured to abut against the case, and the collar member is formed from a metal material having an ionization tendency equal to that of a metal material having a larger ionization tendency, out of metal materials of the shield shell and the case, or is given surface treatment using a metal material having an ionization tendency equal to that of a metal material having a larger ionization tendency, out of the metal materials of the shield shell and the case, or is coated with an insulating material on its surface.

According to still another aspect of the present invention, in the connector, it is possible to configure that the interposed member is formed from an insulating synthetic resin material, and includes a conductive member having electrical conductivity and conducting the shield shell and the case.

According to still another aspect of the present invention, in the connector, it is possible to configure that the conductive member is formed from a metal material having an ionization tendency equal to that of a metal material having a larger ionization tendency, out of metal materials of the shield shell and the case, or is given surface treatment using a metal material having an ionization tendency equal to that of a metal material having a larger ionization tendency, out of the metal materials of the shield shell and the case.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment(s) of a connector according to the present invention will be described in detail on the basis of the drawings. Note that the embodiment(s) is/are not intended to limit the present invention.

Embodiment

An embodiment of the connector according to the present invention will be described on the basis of FIGS. 1 to 9.

Figure 1:
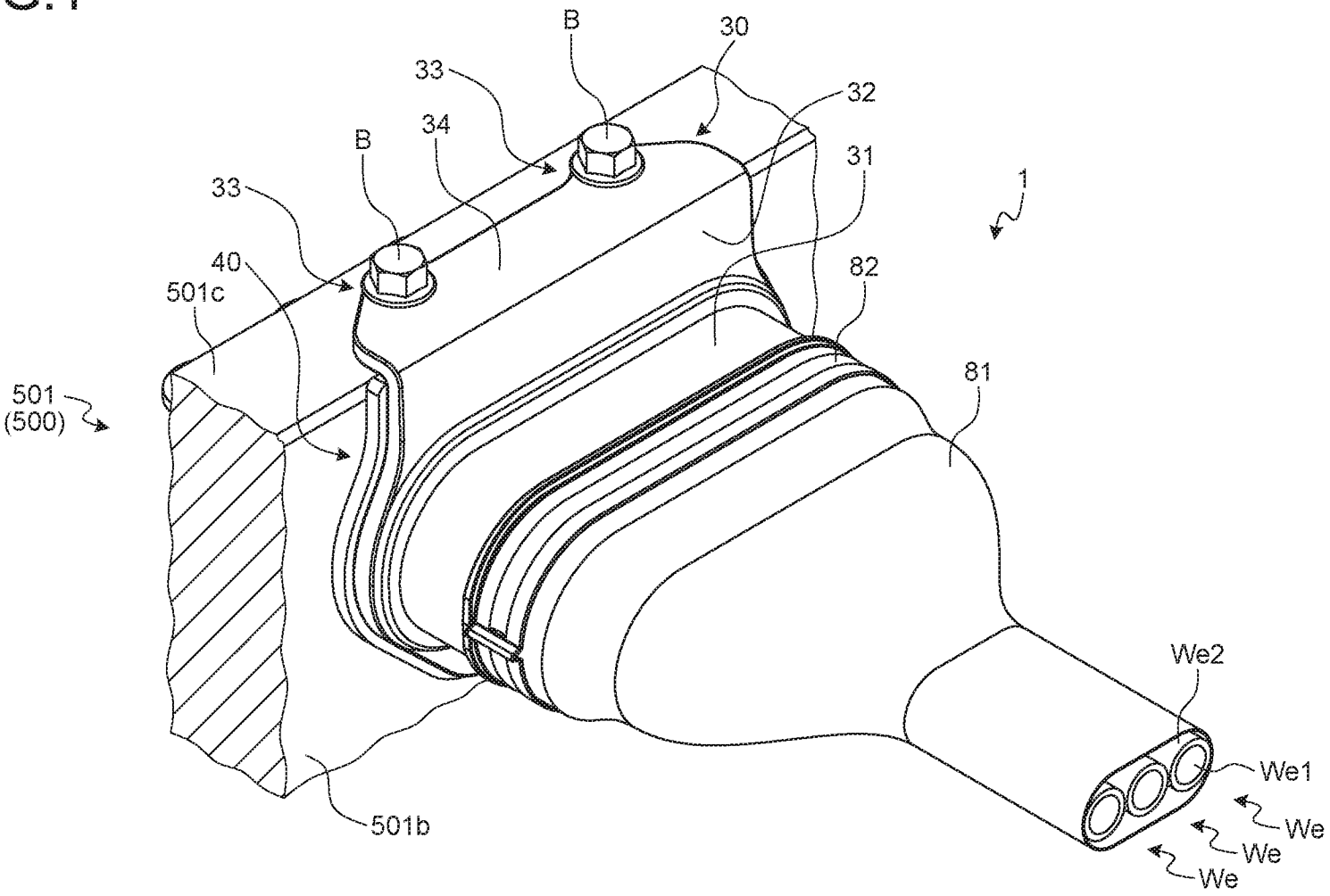
FIG. 1 is a perspective view illustrating a connector of an embodiment mounted on a counterpart device.
Figure 2:
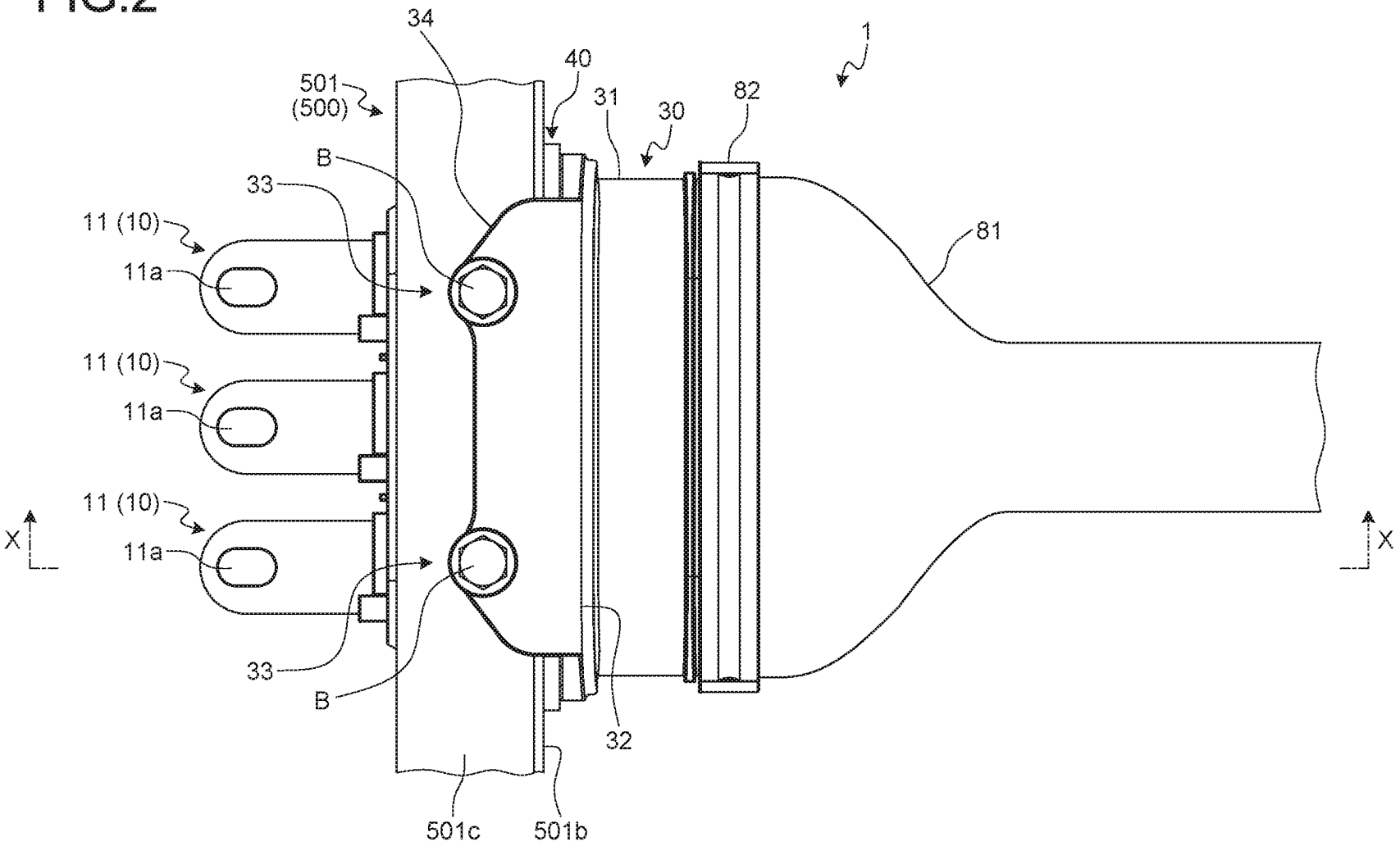
FIG. 2 is a plan view illustrating the connector of the embodiment mounted on the counterpart device.
Figure 3:
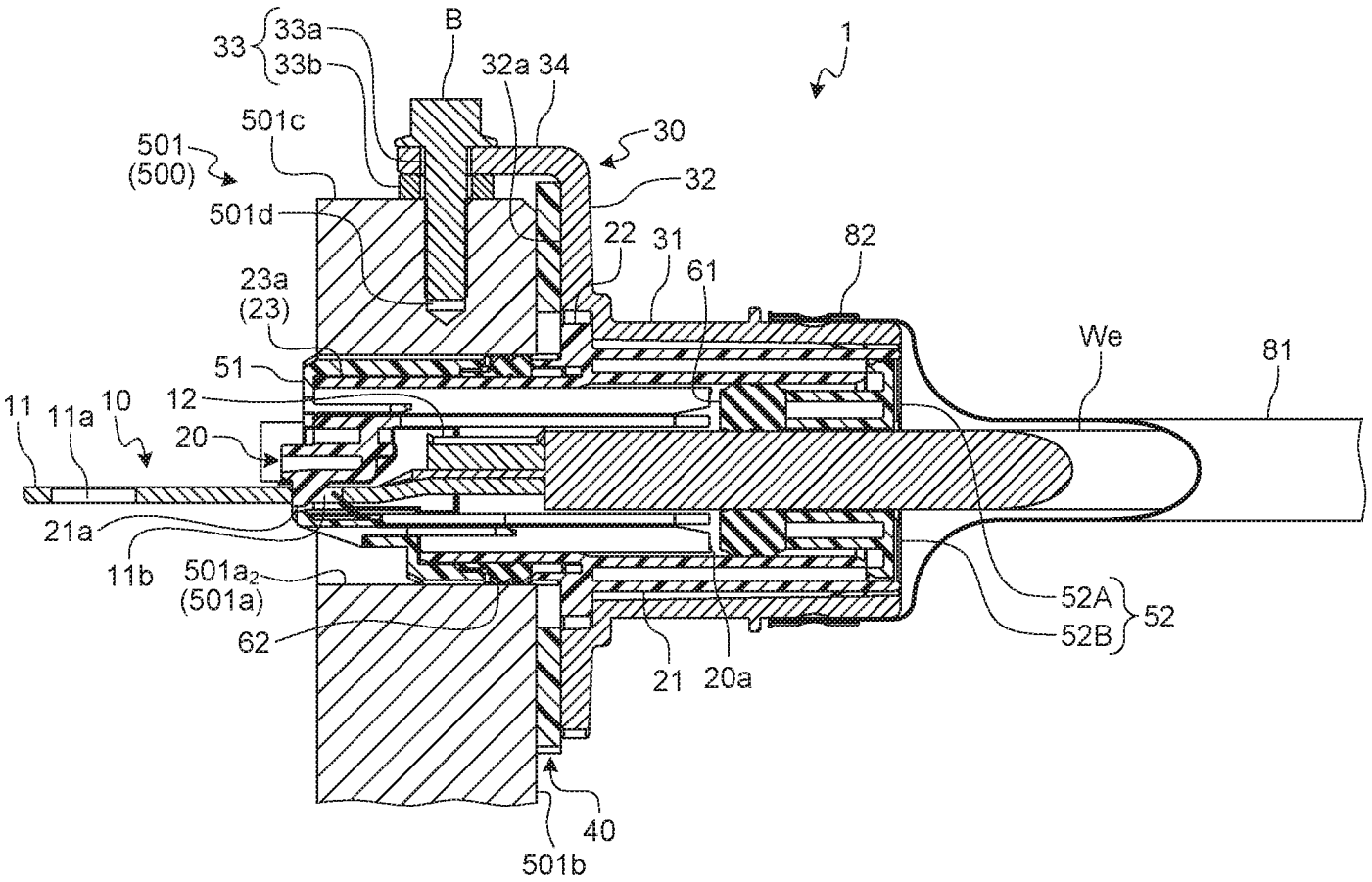
FIG. 3 a cross-sectional view along an X-X line in FIG. 2.
Figure 4:
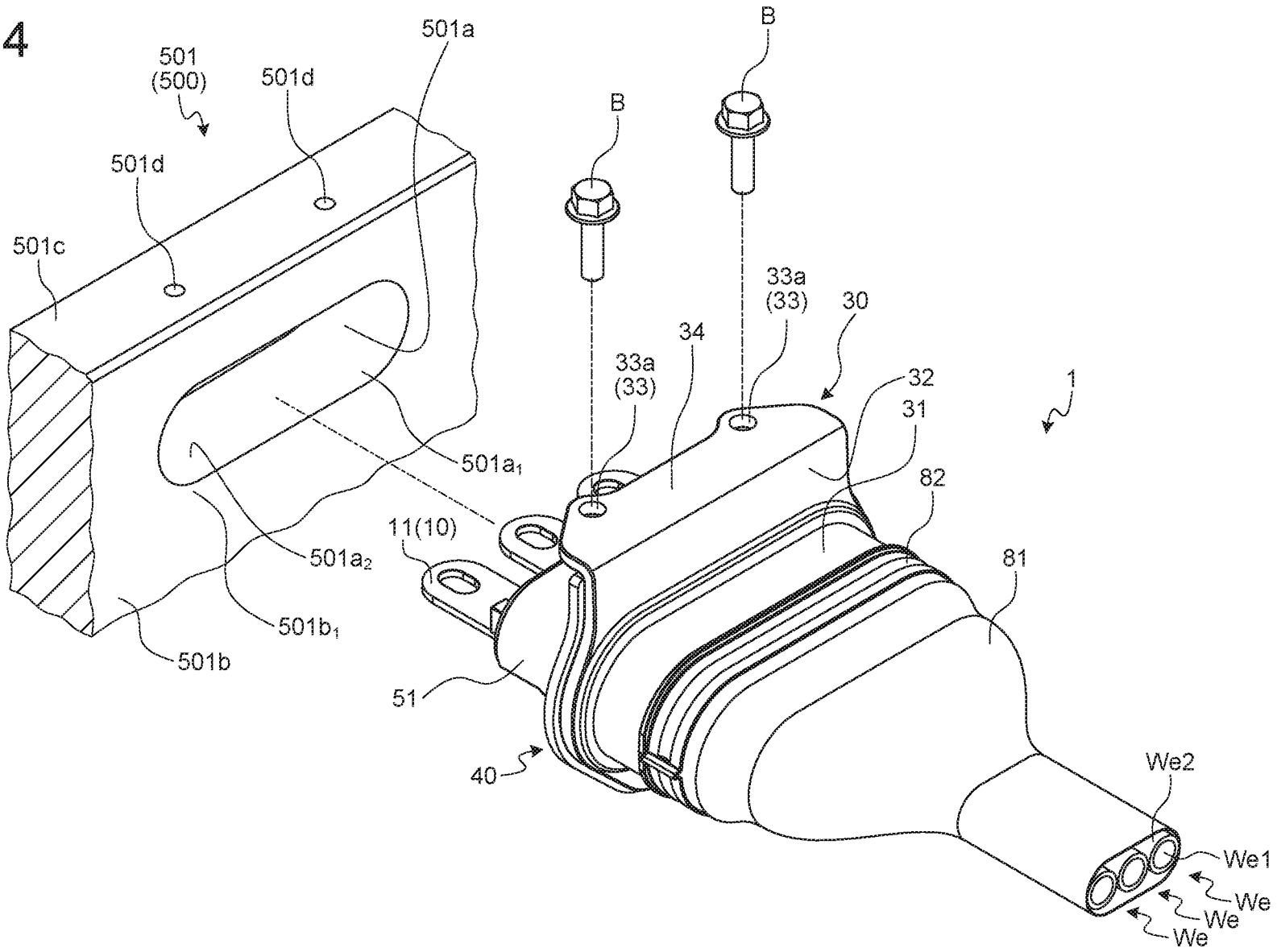
FIG. 4 is a perspective view illustrating the connector of the embodiment before mounted on the counterpart device.
Figure 5:
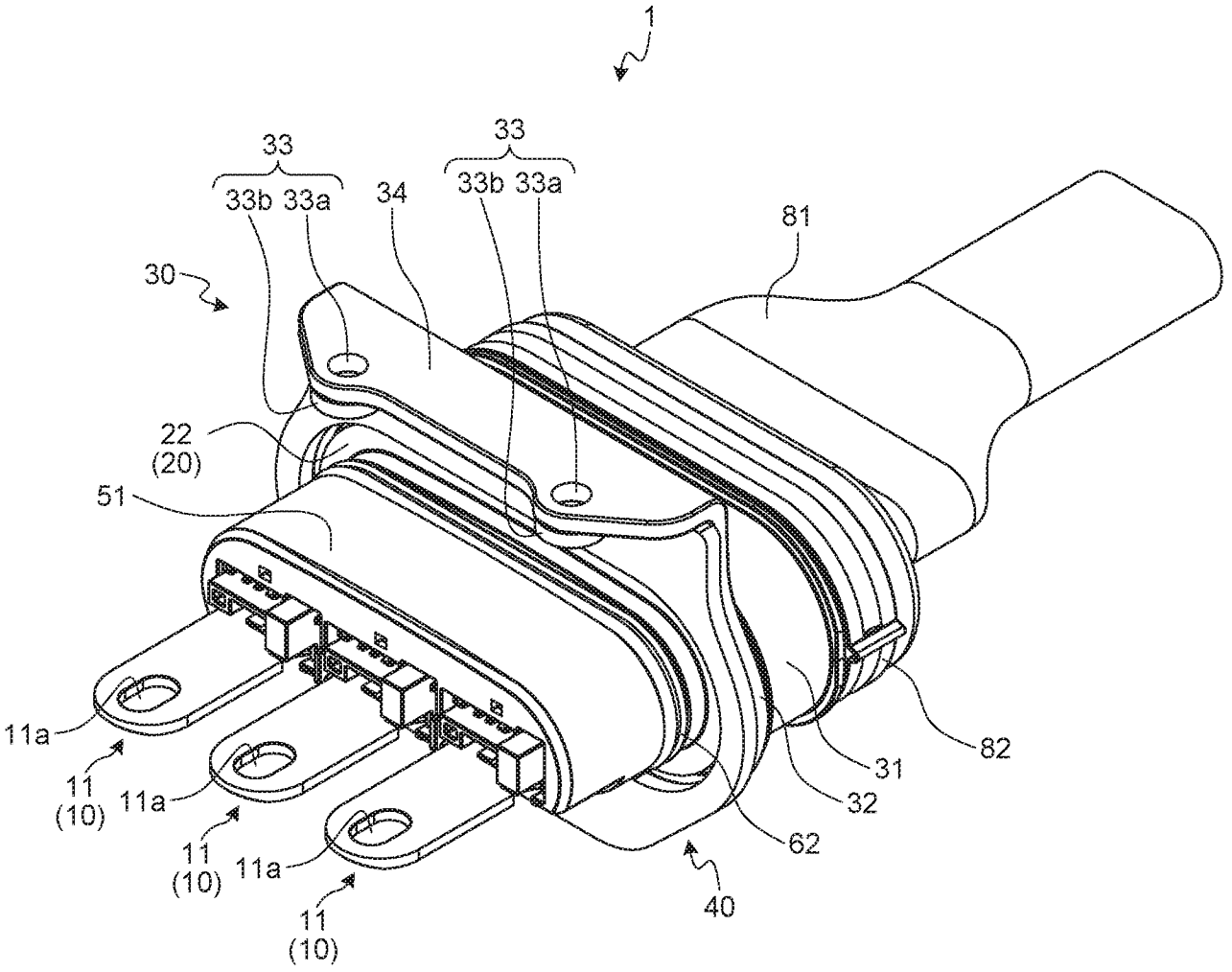
FIG. 5 is a perspective view of the connector of the embodiment as viewed from a terminal metal fitting side.
Figure 6:
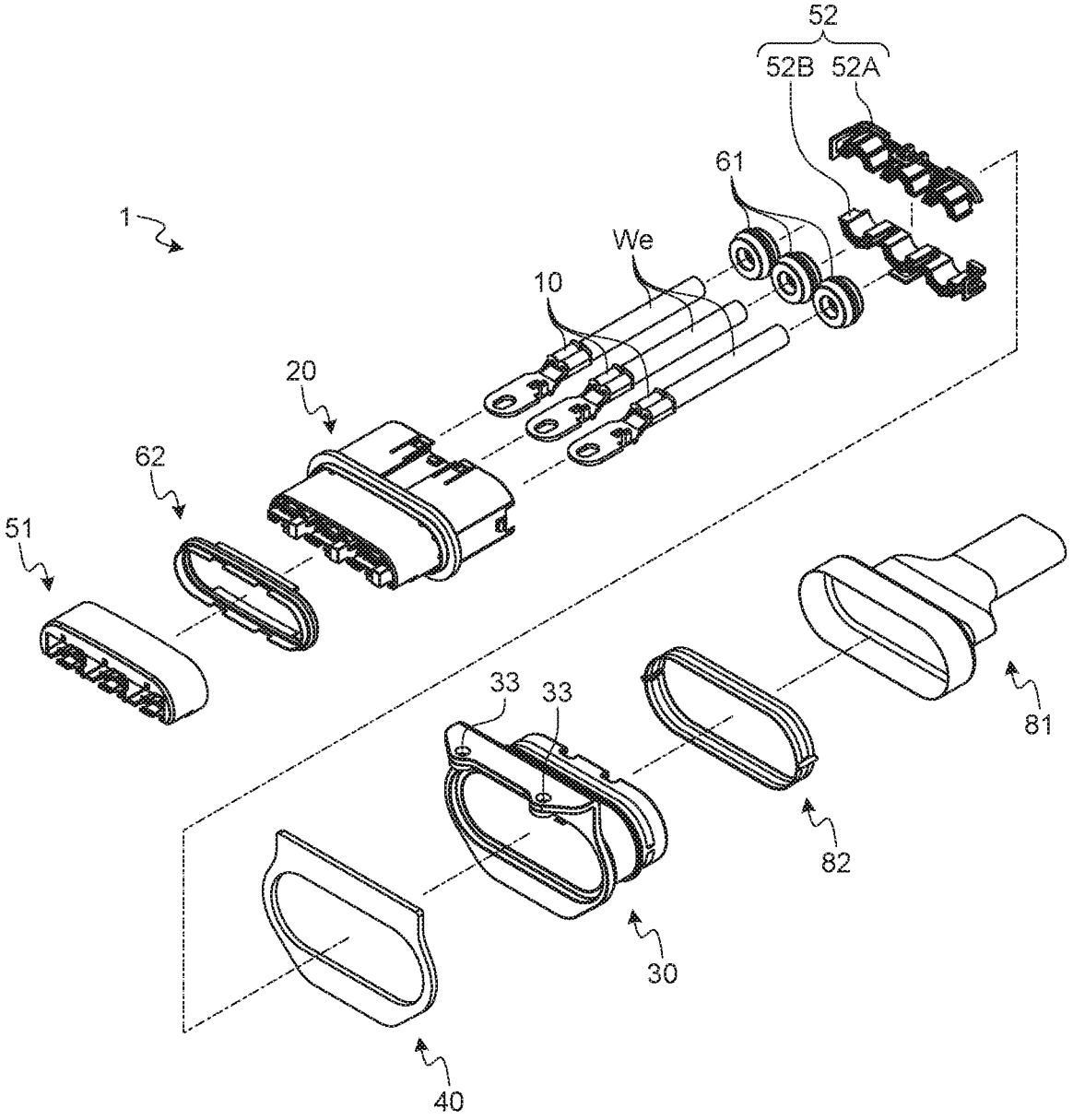
FIG. 6 is an exploded perspective view illustrating the connector of the embodiment.

Reference numeral 1 in FIGS. 1 to 6 denotes a connector of the present embodiment. The connector 1 is electrically connected to a counterpart terminal metal fitting (not illustrated) of a counterpart device 500 to achieve electrical connection between the counterpart. device 500 and a device (not illustrated) connected to an electric wire We (FIGS. 1 to 3). The connector 1 includes a terminal metal fitting 10, a housing 20, a shield shell 30, and an interposed member 40 (FIGS. 3, 5, and 6).

The counterpart device 500 includes a metal case 501 accommodating the counterpart terminal metal fitting or the like. The connector 1 is inserted into a connector insertion hole 501*a* of the case 501 from an opening 501$a_1$ of the connector insertion hole 501*a* (FIGS. 3 and 4). The connector 1 is inserted into and removed from the connector insertion hole 501*a* along a hole-axis direction of the connector insertion hole 501*a*. For the case 501 in this example, a rim of the opening 501$a_1$ of the connector insertion hole 501*a* and its surrounding outer wall surface 501*b* form flat surface orthogonal to the hole-axis direction of the connector insertion hole 501*a* (FIG. 4).

The terminal metal fitting 10 is formed from a metal material. The terminal metal fitting 10 is formed into a predetermined shape by, for example, press forming such as bending and cutting of a metal plate as a base material. The terminal metal fitting 10 is physically and electrically connected to an end of the electric wire We. The terminal metal fitting 10 is inserted into the connector insertion hole 501*a* of the metal case 501 of the counterpart device 500 from the opening 501$a_1$ of the connector insertion hole 501*a*, and is physically and electrically connected to the counterpart terminal metal fitting of the counterpart device 500. The terminal metal fitting 10 thereby achieves electrical connection between the counterpart device 500 and the device connected to the electric wire We. Thus, the terminal metal fitting 10 has a terminal connection part 11 to be physically and electrically connected to the counterpart terminal metal fitting, and an electric wire connection part 12 to be physically and electrically connected to the end of the electric wire We (FIG. 3).

The terminal connection part 11 in this example is formed in a plate-like shape, and a through hole 11*a* is formed therein (FIGS. 2, 3, and 5). The terminal connection part 11 in this example is fixed to the counterpart terminal metal fitting by, for example, a screw to be physically and electrically connected to the counterpart terminal metal fitting. The connection between the terminal metal fitting 10 and the counterpart terminal metal fitting does not necessarily have to be achieved by such a screwing structure. For example, the terminal metal fitting 10 and the counterpart terminal metal fitting may have shapes enabling engaging connection with each other, one of which may be formed into a female terminal shape and the other of which may be formed into a male terminal shape.

The electric wire connection part 12 is, for example, pressure-bonded or welded to a core We1 (FIGS. 1 and 4) at the end of the electric wire We to be physically and electrically connected to the electric wire We. The electric wire connection part 12 in this example is pressure-bonded to the core We1 by connecting two barrel pieces to the stripped core We1 by crimping.

The terminal metal fitting 10 in this example is formed into a straight shape with the terminal connection part 11 and the electric wire connection part 12 arranged on a straight line. Thus, the electric wire We is led out of the electric wire connection part 12 along an extension direction of the terminal metal fitting 10 along the straight line.

The connector 1 in this example includes three pairs of the terminal metal fittings 10 and the electric wires We.

The housing 20 is an accommodation member formed from an insulating material such as a synthetic resin. The housing 20 accommodates the terminal metal fittings 10 and the electric wires We. The terminal metal fittings 10 are held in the housing 20, and the electric wires We are led out of the housing 20.

Figure 7:
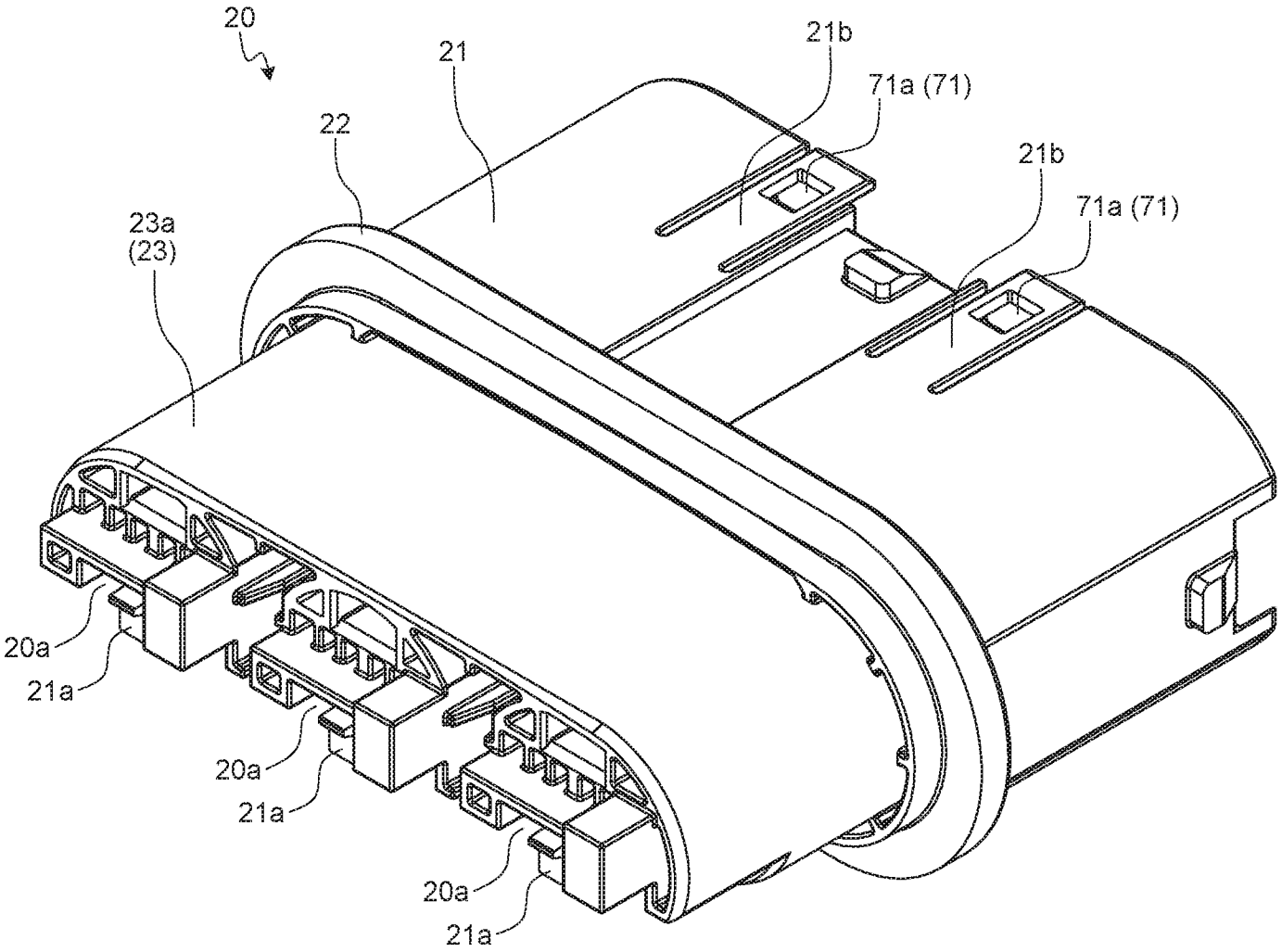
FIG. 7 is a perspective view illustrating a housing.

A housing chamber 20*a* accommodating one terminal metal fitting 10 and one electric wire We is formed inside the housing 20 (FIGS. 3 and 7). The housing chamber 20*a* accommodates the electric wire connection part 12 of the terminal metal fitting 10 and the end of the electric wire We. The housing chamber 20*a* has openings at opposite ends across the inside of the chamber. The housing chamber 20*a* accommodates the terminal metal fitting 10 so as to align a direction in which the opposite ends are opposed to each other with the extension direction. In the housing 20, the terminal connection part 11 of the terminal metal fitting 10 is protruded out of the housing chamber 20*a* from an opening at a first end, and the electric wire We is led out of the housing chamber 20*a* from an opening at a second end oppositely from a protrusion direction of the terminal connection part 11. The opening at the second end serves as an electric wire lead-out opening. The housing chamber 20*a* of the housing 20 is formed for each of the pairs of the terminal metal fittings 10 and the electric wires We.

The housing 20 in this example has a cylindrical body 21 formed in an elliptical or quadrangular tube shape (FIGS. 3 and 7). In this example, the cylindrical body 21 is formed in an elliptical tube shape. The respective housing chambers 20*a* are formed inside the cylindrical body 21 of the housing 20 from a first end to a second end of the cylindrical body 21. In the housing 20, the openings at the first ends of the housing chambers 20*a* are formed at the first end of the cylindrical body 21, and the openings at the second ends of the housing chambers 20*a* are formed at the second end of the cylindrical body 21. Additionally, the respective housing chambers 20*a* are arranged in a row along a direction orthogonal to a cylinder-axis direction of the cylindrical body 21 inside the cylindrical body 21. Thus, the respective terminal connection parts 11 are protruded from the first end of the cylindrical body 21 of the housing 20, and the respective electric wires We are led out from the second end of the cylindrical body 21.

Claws 21*a* are formed on the first end sides of the housing chambers 20*a* of the cylindrical body 21 (FIGS. 3 and 7). The terminal metal fittings 10 are held in the housing 20 with the claws 21*a* inserted into through holes 11*b* of the terminal connection parts 11 when accommodated in the housing chambers 20*a* (FIG. 3).

The housing 20 in this example also has an annular flange 22 protruded outward from an outer circumferential wall of the cylindrical body 21 and extending along a circumferential direction of the outer circumferential wall (FIGS. 3 and 7). The flange 22 is disposed on the outer circumferential wall of the cylindrical body 21 around a middle position in the cylinder-axis direction. For the housing 20, the first end side in the cylinder-axis direction of the cylindrical body 21 from the flange 22 is inserted into the connector insertion hole 501*a* of the case 501, and the second end side in the cylinder-axis direction of the cylindrical body 21 from the flange 22 is placed outside the case 501.

The first end side in the cylinder-axis direction of the cylindrical body 21 from the flange 22 is used as a connector insertion part 23 to be inserted into the connector insertion hole 501*a* from the opening 501$a_1$ together with the terminal metal fittings 10 (FIGS. 3 and 7). The connector 1 of the present embodiment includes a front holder 51 that is attached to the connector insertion part 23 to maintain the held states of the respective terminal metal fittings 10 in the housing 20 (FIGS. 3, 5, and 6). The front holder 51 covers the first end side of the connector insertion part 23 from the outside, and the respective terminal connection parts 11 are protruded from the front holder 51. Although not illustrated, the front holder 51 is held on the connector insertion part 23 by a holding structure including a claw and a hole. The front holder 51 is formed from an insulating material such as a synthetic resin.

Meanwhile, the electric wire lead-out openings of the respective housing chambers 20*a* are disposed on the second end side in the cylinder-axis directs ion of the cylindrical body 21 from the flange 22. The respective electric wire lead-out openings communicate with each other. The connector 1 of the present embodiment includes a rear holder 52 that is fitted into the respective electric wire lead-out openings communicating with each other and holds the respective electric wires We while directing the respective electric wires We to a lead-out direction (FIGS. 3 and. 6). The rear holder 52 in this example employs a two-split structure having a first holder member 52A and a second holder member 52B. The first holder member 52A and the second holder member 52B sandwich and hold the respective electric wires We. The respective electric wires We are led out via the rear holder 52. Although not illustrated, the rear holder 52 is held in the housing 20 by a holding structure including a claw and a hole. The first holder member 52A and the second holder member 52B are formed from an insulating material such as a synthetic resin.

Additionally, a rubber plug 61 is disposed in the housing chamber 20*a* of the housing 20 at a position inward of the rear holder 52 (FIGS. 3 and 6). The rubber plug 61 is a liquid seal member for preventing liquid such as water from flowing toward the terminal metal fitting 10 from the electric wire lead-out opening. The rubber plug 61 is formed in an annular shape so as to seal an annular gap between an outer circumferential surface of a coating We2 (FIGS. 1 and 4) of the electric wire We and an inner circumferential surface of the housing chamber 20*a*. The rubber plug 61 is provided for each of the electric wires We. The rubber plug 61 is accommodated in the housing chamber 20*a* together with the electric wire We. The rubber plug 61 fills the annular gap between the electric wire We and the housing chamber 20*a* with its inner circumferential wall being in close contact with the outer circumferential surface of the coating We2 of the electric wire We, and its outer circumferential wall with the inner circumferential surface of the housing chamber 20*a*. The rubber plug 61 in this example is sandwiched between the housing 20 and the rear holder 52 in the cylinder-axis direction.

The connector 1 includes a liquid seal member 62 sealing a gap between the housing 20 and the rim of the opening 501$a_1$ of the case 501 (FIGS. 3 and 6). The liquid seal member 62 described here seals an annular gap between an outer circumferential surface 23*a* (FIGS. 3 and 7) of the connector insertion part 23 of the housing 20 and an inner circumferential surface 501$a_2$ (FIGS. 3 and 4) of the connector insertion hole 501*a* of the case 501. The liquid seal member 62 is a so-called gasket having liquid seal properties. The liquid seal member 62 fills the annular gap between the connector insertion part 23 and the connector insertion hole 501*a* with its inner circumferential wall being in close contact with the outer circumferential surface 23*a* of the connector insertion part 23, and its outer circumferential wall with the inner circumferential surface 501$a_2$ of the connector insertion hole 501*a*. The liquid seal member 62 in this example is sandwiched between the flange 22 of the housing 20 and the front holder 51 in the cylinder-axis direction.

The shield shell 30 is formed from a metal material (e.g., stainless steel) so as to prevent noise intrusion from the outside. The shield shell 30 has a cylindrical accommodation body 31 accommodating the housing 20 therein (FIGS. 1 to 5, 8, and 9). The accommodation body 31 formed in an elliptical or quadrangular tube shape. The accommodation body 31 in this example is formed in an elliptical tube shape. In the shield shell 30, the connector insertion part 23 of the housing 20 is protruded from an opening at a first end of the accommodation body 31, and the respective electric wires We led out of the rear holder 52 are led out from an opening at a second end of the accommodation body 31. That is, the accommodation body 31 is placed outside the case 501.

Figure 8:
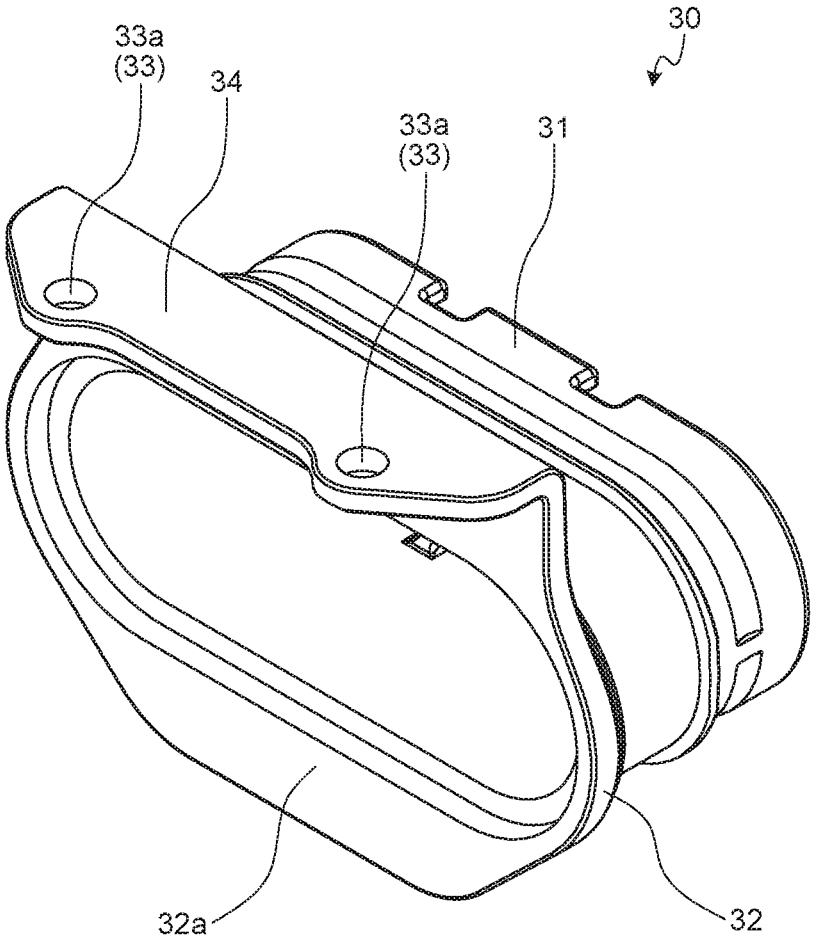
FIG. 8 is a perspective view illustrating a shield shell.

The shield shell 30 also has an annular flange 32 to be opposed to an annular surface 501$b_1$ around the rim of the opening 501$a_1$ in the outer wall surface 501*b* of the case 501 (FIGS. 1 to 5, 8, and 9). The flange 32 is formed in an annular and planar shape protruded outward from a rim of the opening at the first end of the accommodation body 31 and extending along a circumferential direction of the rim. An annular flat surface 32*a* of the flange 32 forms a flat surface orthogonal to the hole-axis direction of the connector insertion hole 501*a* when the connector insertion part 23 is inserted into the connector insertion hole 501*a* (FIGS. 3 and 8). When the connector insertion part 23 is inserted into the connector insertion hole 501*a*, a gap is formed with an equal distance between the flat surface 32*a* of the flange 32 and the annular surface 501$b_1$ in the outer wall surface 501*b* of the case 501.

The shield shell 30 also has a fixed part 33 to be fixed to the case 501 (FIGS. 1 to 4, 8, and 9). The case 501 described here has, for example, an orthogonal wall surface 501*c* orthogonally connected to the outer wall surface 501*b* (FIGS. 1 to 4). The shield shell 30 is mounted on the orthogonal wall surface 501*c* by the fixed part 33 to be fixed to the case 501. Thus, a fixing part 501*d* to which the fixed part 33 is fixed is disposed in the orthogonal wall surface 501*c* (FIGS. 3 and 4). The fixing part 501*d* is formed as, for example, a female threaded part whose thread axis is aligned with a direction orthogonal to the orthogonal wall surface 501*c*. The fixed part 33 is fixed to the orthogonal wall surface 501*c* by screwing a male threaded member B (FIGS. 1 to 4) into the fixing part 501*d*. In this example, the pair of the fixed part 33 and the fixing part 501*d* is provided at two positions.

The fixed part 33 in this example is disposed in a plate body 34 orthogonally connected to the flange 32 (FIGS. 1 to 5, 8, and 9). The fixed part 33 has a circular through hole 33*a* formed in the plate body 34 coaxially with the male threaded member B and the fixing part 501*d* as the female threaded part, and a cylindrical collar member 33*b* arranged coaxially with the through hole 33*a* (FIGS. 3 and 5). The through hole 33*a* and the collar member 33*b* are arranged so as to align their axes with the thread axes of the fixing part 501*d* as the female threaded part and the male threaded member B. Thus, the fixed part 33 is fixed to the orthogonal wall surface 501*c* by screwing the male threaded member B inserted through the through hole 33*a* and the collar member 33*b* into the fixing part 501*d* as the female threaded part.

The collar member 33*b* is at least partially placed between the through hole 33*a* and the fixing part 501*d* so as to bring one of annular end surfaces thereof into abutment against the orthogonal wall surface 501*c* of the case 501. For example, the collar member 33*b* may be interposed between the through hole 33*a* and the fixing part 501*d* to be sandwiched between the plate body 34 and the orthogonal wall surface 501*c*, or may be coaxially fitted into the through hole 33*a* so as to protrude at least one end thereof close to the fixing part 501*d* from the plate body 34. In this embodiment, the collar member 33*b* is interposed between the through hole 33*a* and the fixing part 501*d*. The collar member 33*b* is connected to, for example, the through hole 33*a* of the plate body 34 by crimping.

The collar member 33*b* is formed from, for example, a metal material. In this case, the collar member 33*b* configured as follows in accordance with one of the shield shell 30 and the case 501 made of a metal material having a larger ionization tendency.

For example, the collar member 33*b* is preferably formed from a metal material having an ionization tendency equal or substantially equal to that of a metal material having a larger ionization tendency, out of the metal materials of the shield shell 30 and the case 501. Thus, a potential difference is reduced between the collar member 33*b* and the one made of the metal material having a larger ionization tendency in the connector 1. This prevents the occurrence of galvanic corrosion in the one made of the metal material having a larger ionization tendency. Moreover, when the male threaded member B is also formed from a metal material, the male threaded member B is preferably formed from a metal material having an ionization tendency equal or substantially equal to that of a metal material having a larger ionization tendency, out of the metal materials of the shield shell 30 and the case 501. Thus, a potential difference is reduced between the male threaded member B and the one made of the metal material having a larger ionization tendency in the connector 1. This prevents the occurrence of galvanic corrosion in the one made of the metal material having a larger ionization tendency. In this example, the case 501 has a larger ionization tendency than the shield shell 30. Thus, the collar member 33*b* and the male threaded member B are formed from a metal material having an ionization tendency equal or substantially equal to that of the case 501.

Additionally, the collar member 33*b* and the male threaded member B may not be formed from the metal material having an ionization tendency equal or substantially equal to that of a metal material having a larger ionization tendency, out of the metal materials of the shield shell 30 and the case 501 in some cases. In this case, the collar member 33*b* and the male threaded member B are preferably given surface treatment using the metal material having an ionization tendency equal or substantially equal to that of a metal material having a larger ionization tendency, out of the metal materials of the shield shell 30 and the case 501. The potential difference is thereby also reduced between the collar member 33*b* and the one made of the metal material having a larger ionization tendency in the connector 1. This prevents the occurrence of corrosion in the one made of the metal material having a larger ionization tendency. Additionally, the potential difference is reduced between the male threaded member B and the one made of the metal material having a larger ionization tendency in the connector 1. This prevents the occurrence of corrosion in the one made of the metal material having a larger ionization tendency. In this example, the case 501 has a larger ionization tendency than the shield shell 30. Thus, the collar member 33*b* and the male threaded member B are given surface treatment using the metal material having an ionization tendency equal or substantially equal to that of the case 501. For example, when the case 501 is formed from aluminum, the surfaces of the collar member 33*b* and the male threaded member B may be given alumite treatment or plated with tin.

Moreover, the surfaces of the collar member 33*b* and the male threaded member B may be coated with an insulating material (for example, coated with an insulating synthetic resin material). Thus, a potential difference generated by contact between metals is eliminated between the shield shell 30 and the case 501 in the connector 1. This prevents the occurrence of corrosion in one of the shield shell 30 and the case 501 made of the metal material having a larger ionization tendency (the case 501 in this embodiment).

Additionally, the collar member 33*b* may be formed from an insulating synthetic resin material that achieves rigidity of a desired value.

The fixed part 33 may coaxially fit the collar member 33*b* into the through hole 33*a*.

Figure 9:
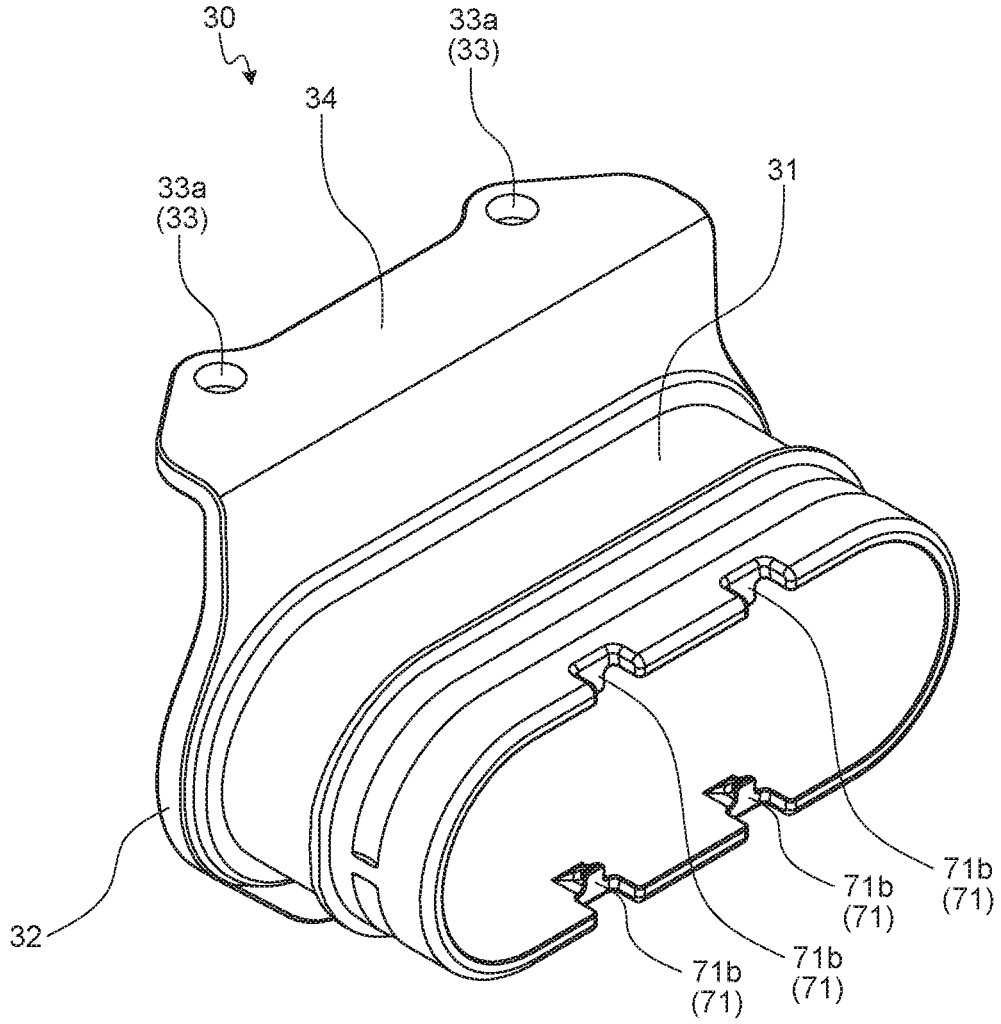
FIG. 9 is a perspective view of the shield shell as viewed from another angle.
Figure 10:
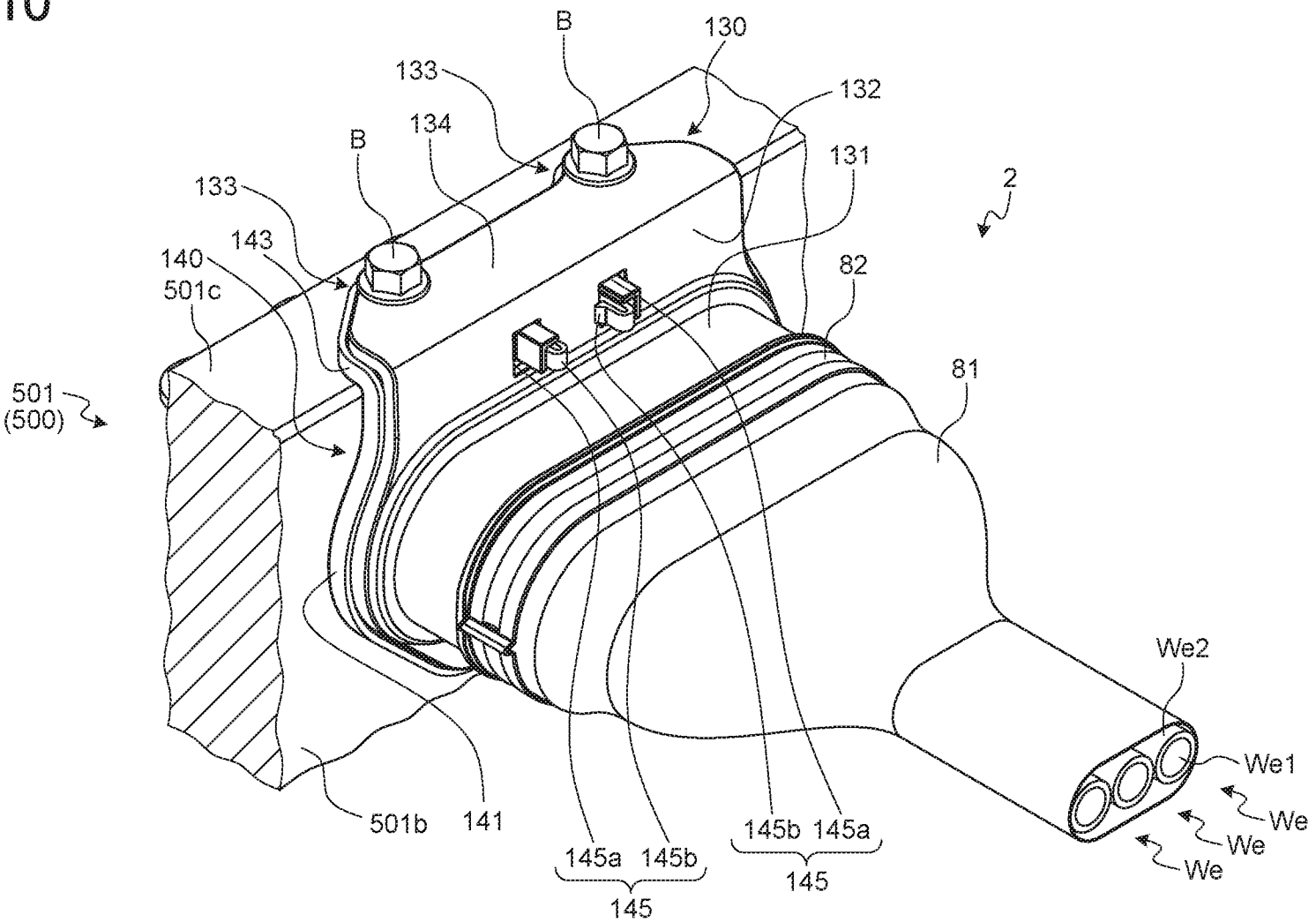
FIG. 10 is a perspective view illustrating a connector of a modification mounted on a counterpart device.
Figure 11:
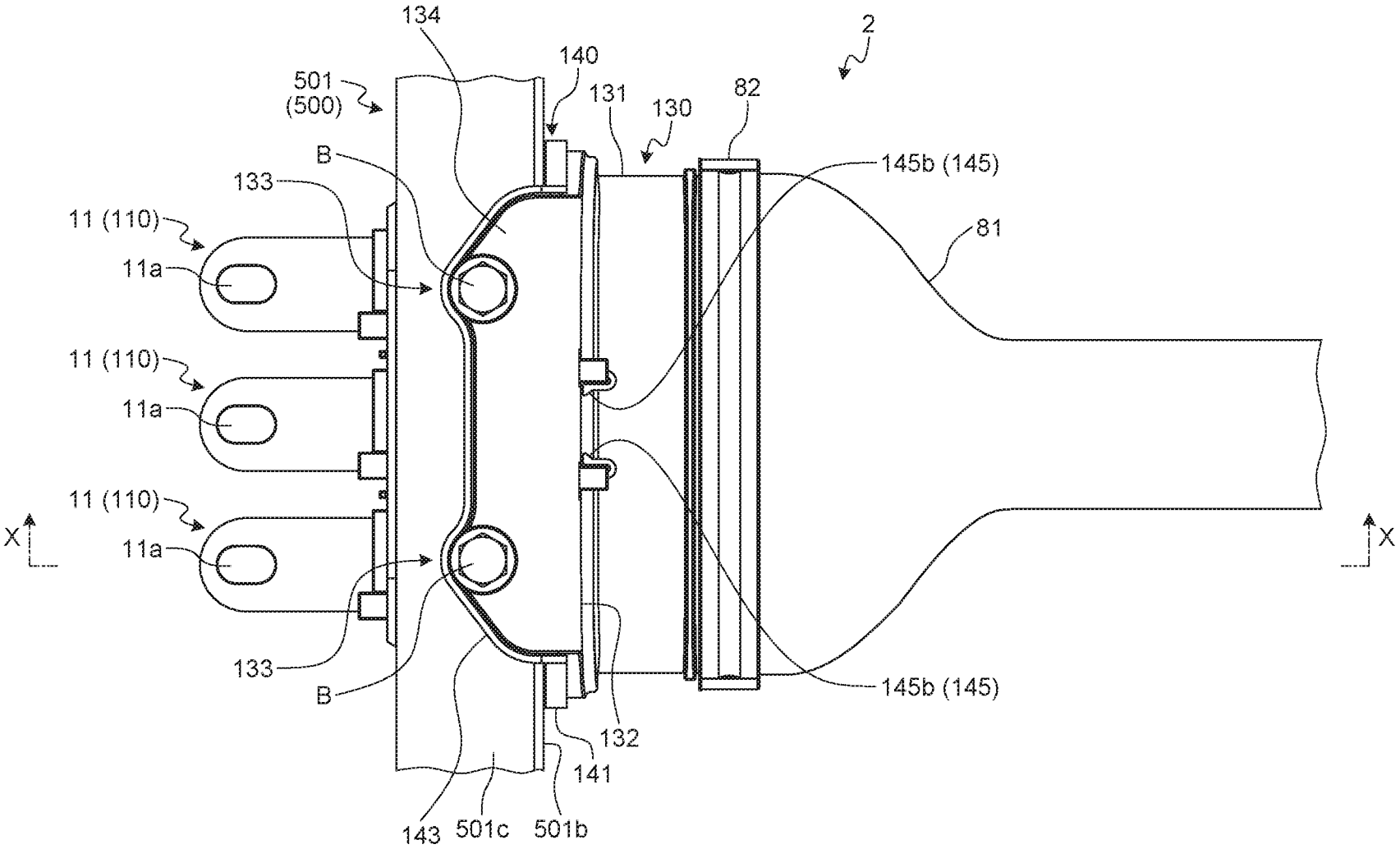
FIG. 11 is a plan view illustrating the connector of the modification mounted on the counterpart device.

The shield shell 30 is held on the housing 20 accommodated therein. A first holding structure 71 is disposed between the housing 20 and the shield shell 30 so as to hold the shield shell 30 on the housing 20 (FIGS. 7 and 9). The first holding structure 71 includes a first engagement part 71*a* (FIG. 7) disposed in the cylindrical body 21 of the housing 20, and a second engagement part 71*b* (FIG. 9) disposed in the shield shell 30. One of the first engagement part 71*a* and the second engagement part 71*b* is formed as a claw, and the other is formed as a through hole or a groove for locking the claw with insertion of the claw. In this example, the first engagement part 71*a* is formed as the through hole (FIG. 7), and the second engagement part 71*b* is formed as the claw (FIG. 9). The pair of the first engagement part 71*a* and the second engagement part 71*b* is provided at four positions in the first holding structure 71.

A plate 21*b* sandwiched. between two cutouts to have a cantilever shape is formed on the second end side of the cylindrical body 21 (FIG. 7). The plate 21*b* has flexibility. Each first engagement part 71*a* is disposed on a free end side of the plate 21*b*. The plate 21*b* is bent toward the housing chamber 20*a* by the second engagement part 71*b* as the claw while the housing 20 is being accommodated in the shield shell 30. The bend of the plate 21*b* is eliminated with the second engagement part. 71*b* inserted into the first engagement part 71*a*. Eliminating the bend of the plate 21*b* allows the second engagement part 71*b* to be locked to a peripheral edge of the first engagement part 71*a*. The first holding structure 71 thereby holds the shield shell 30 on the housing 20.

Additionally, in the connector 1, the respective electric wires We led out from the opening at the second end of the shield shell 30 are covered by a braid 81 so as to further prevent noise intrusion from the outside (FIGS. 1 to 6). The braid 81 is a member obtained by braiding a metal material in a cylindrical mesh shape. The braid 81 covers an outer circumferential wall on the second end side of the shield shell 30 from the outside, and as in pressure contact with the outer circumferential wall on the second end side of the shield shell 30 by using a cylindrical connection member 82 (FIGS. 1 to 6). The connector 1 thereby maintains an electrical connection state between the shield shell 30 and the braid 81.

The interposed member 40 is interposed between the flange 32 of the shield shell 30 and the annular surface 501$b_1$ in the outer wall surface 501*b* of the case 501 to be sandwiched between the annular flat surface 32*a* of the flange 32 and the annular surface 501$b_1$ (FIGS. 1 to 4). The interposed member 40 is formed in an annular and planar shape extending along a circumferential direction of the flange 32 and the annular surface 501$b_1$ (FIGS. 5 and 6). One of flat surfaces of the interposed member 40 is brought into contact with the annular flat surface 32*a* of the flange 32, and the other of the flat surfaces with the annular surface 501$b_1$ of the case 501. In this example, the interposed member 40 is fixed to the shield shell 30. For example, the interposed member 40 is stuck to the flange 32 of the shield shell 30 by using an adhesive sheet.

The interposed member 40 is formed from a resin material. The interposed member 40 thereby prevents contact between the shield shell 30 and the case 501 in the connector 1. In the connector 1, when the shield shell 30 and the case 501 are formed from metal materials having different ionization tendencies, a potential difference generated by contact between metals is eliminated between the shield shell 30 and the case 501. This prevents the occurrence of corrosion in one of the shield shell 30 and the case 501 made of a metal material having a larger ionization tendency (the case 501 in this embodiment). The interposed member 40 of the present embodiment is formed from, for example, a conductive rubber material. In this case, the adhesive sheet is also provided with conductivity. Thus, in the connector 1 of the present embodiment, the interposed member 40 achieves electrical connection between the shield shell 30 and the case 501 while preventing corrosion between the shield shell 30 and the case 501.

As described above, the connector 1 of the present embodiment can prevent the occurrence of corrosion between the shield shell 30 and the case 501 by interposing the interposed member 40 made of the resin material (conductive rubber material) therebetween. That is, even when the shield shell 30 and the case 501 are formed from different metal materials (particularly metal materials having a large potential difference resulting from a difference in ionization tendency), the connector 1 can prevent the occurrence of corrosion in the one having a larger ionization tendency because of the interposed member 40 made of the resin material and interposed between the shield shell 30 and the case 501. Additionally, in the connector 1 of the present embodiment, the collar member 33*b* is interposed between the shield shell 30 and the case 501. Forming the collar member 33*b* from the material described above, giving the surface treatment thereto as described above, or the like allows the occurrence of corrosion to be prevented in one of the shield shell 30 and the case 501 made of the metal material having a larger ionization tendency. As described above, the connector 1 of the present embodiment can improve its durability. The connector 1 of the present embodiment can improve the durability of the counterpart device 500 as well as improving its durability.

Modification

Figure 12:
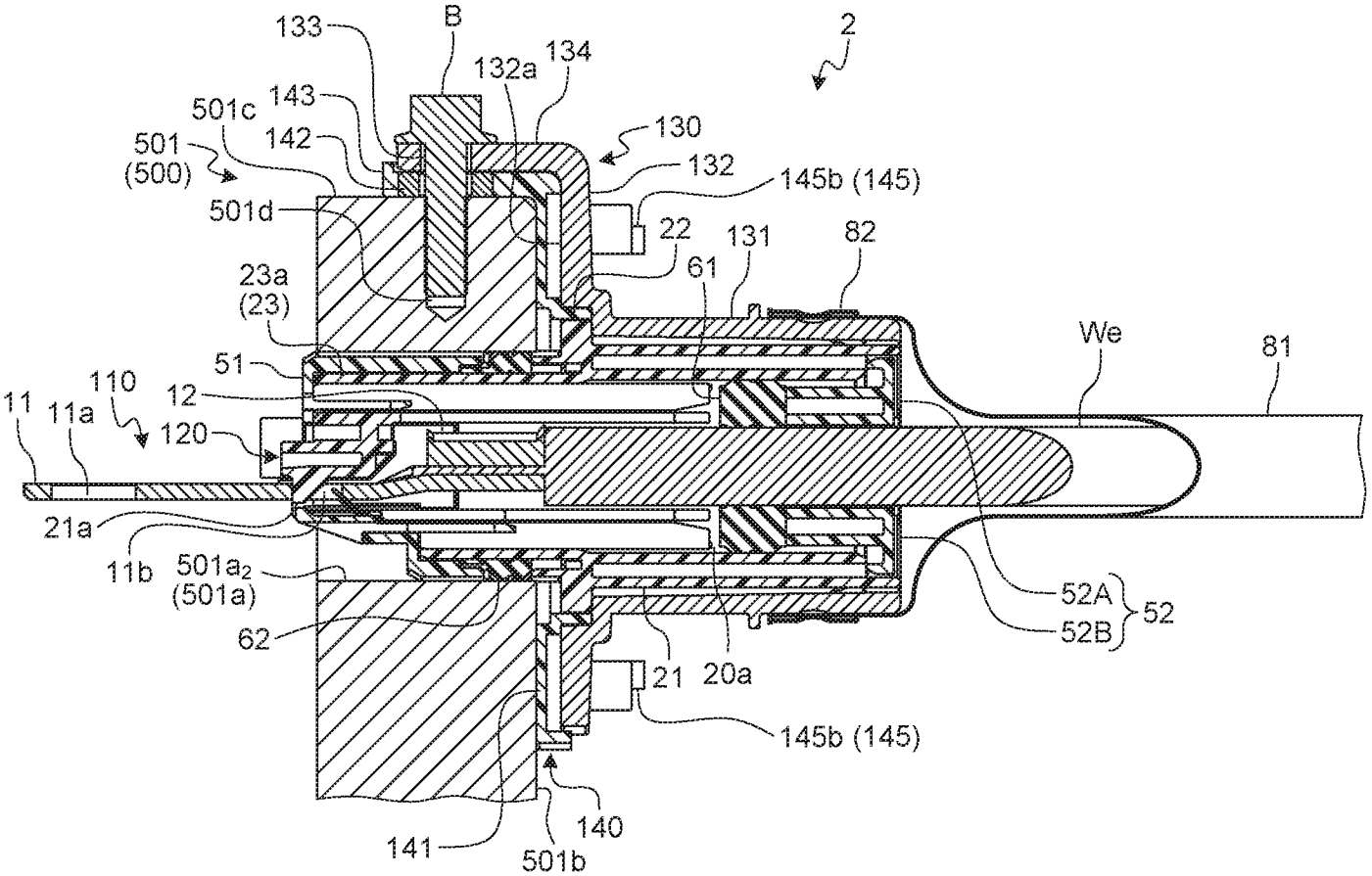
FIG. 12 is a cross-sectional view along an X-X line in FIG. 11.
Figure 13:
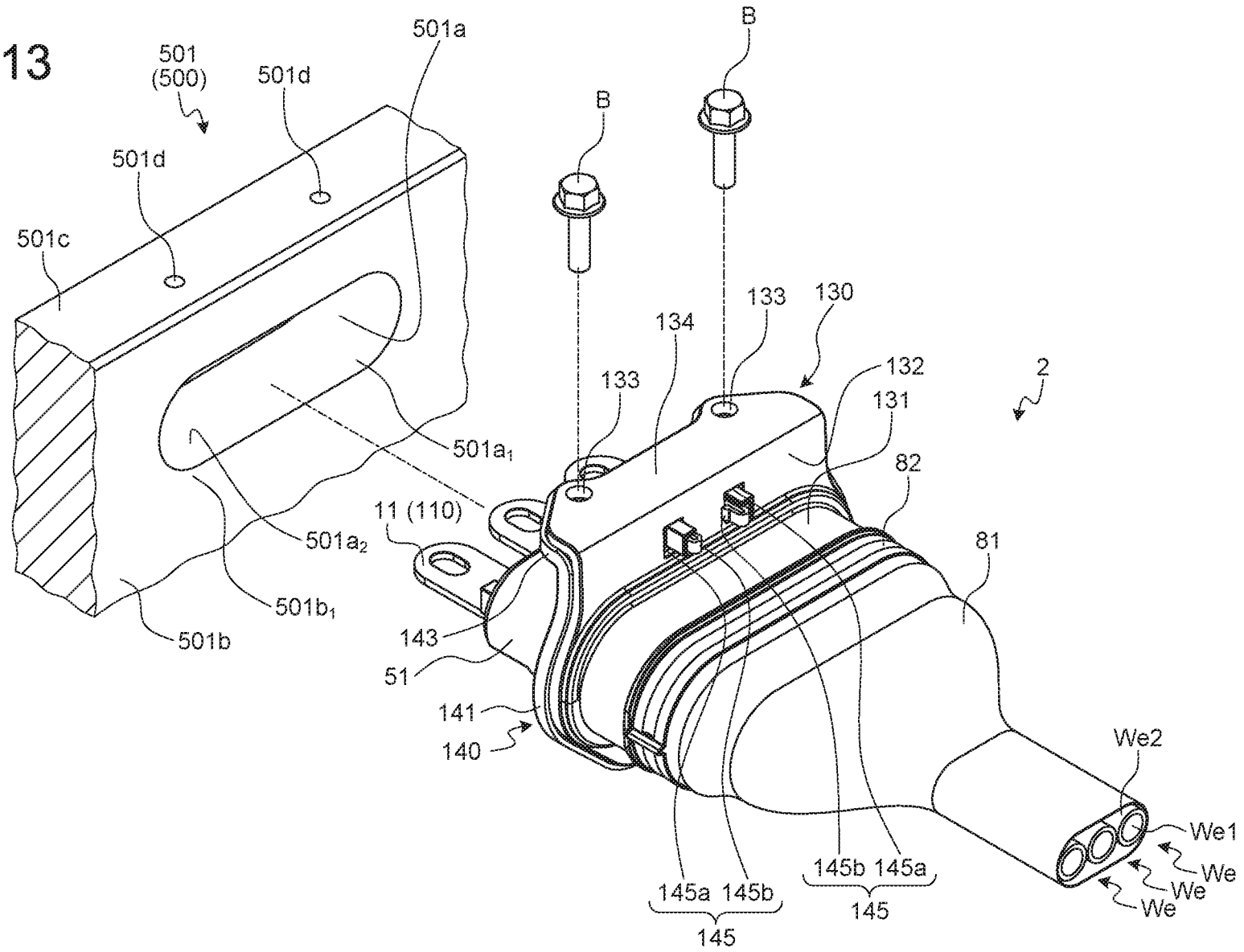
FIG. 13 is a perspective view illustrating the connector of the modification before mounted on the counterpart device.
Figure 14:
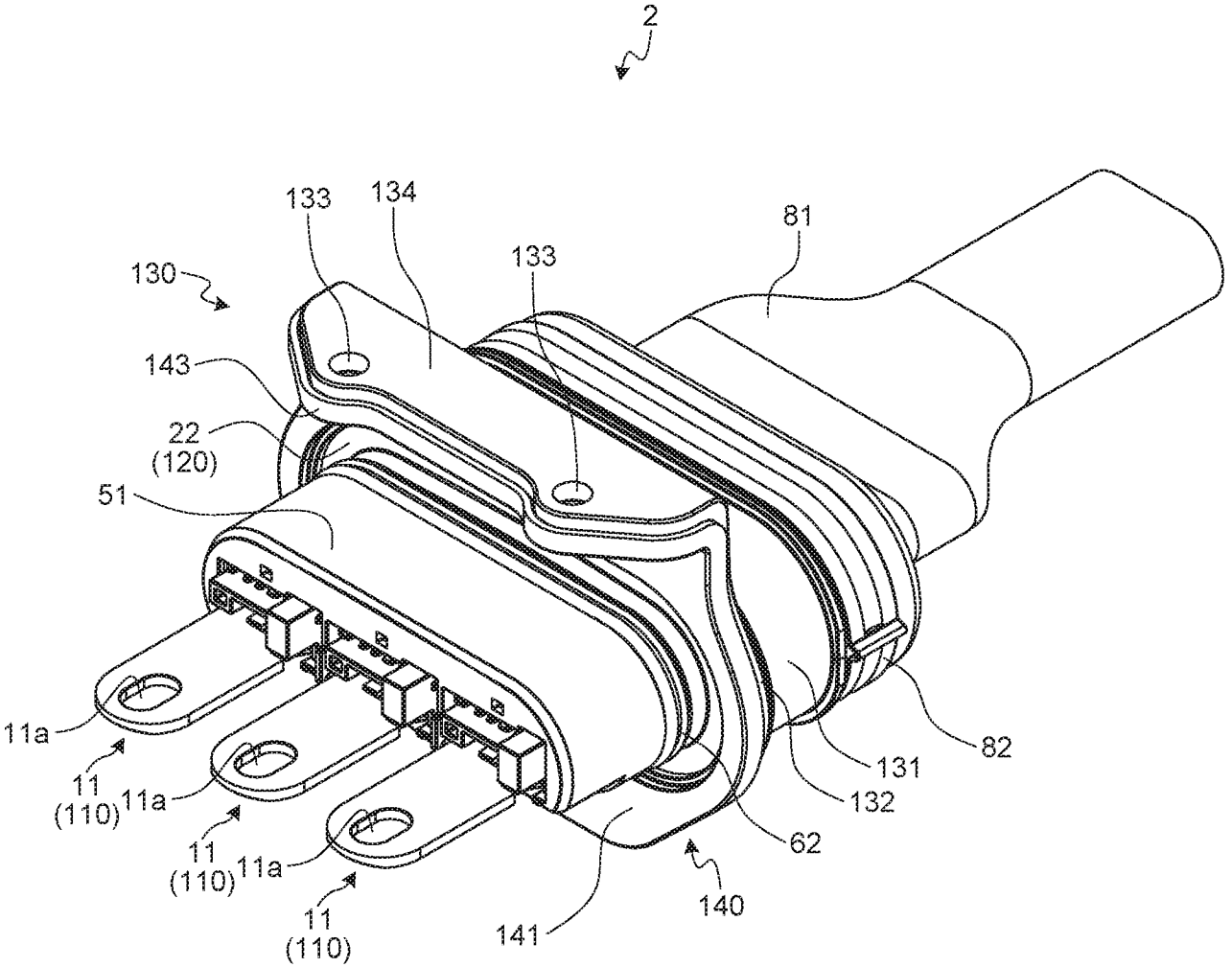
FIG. 14 is a perspective view of the connector of the modification as viewed from a terminal metal fitting side.
Figure 15:
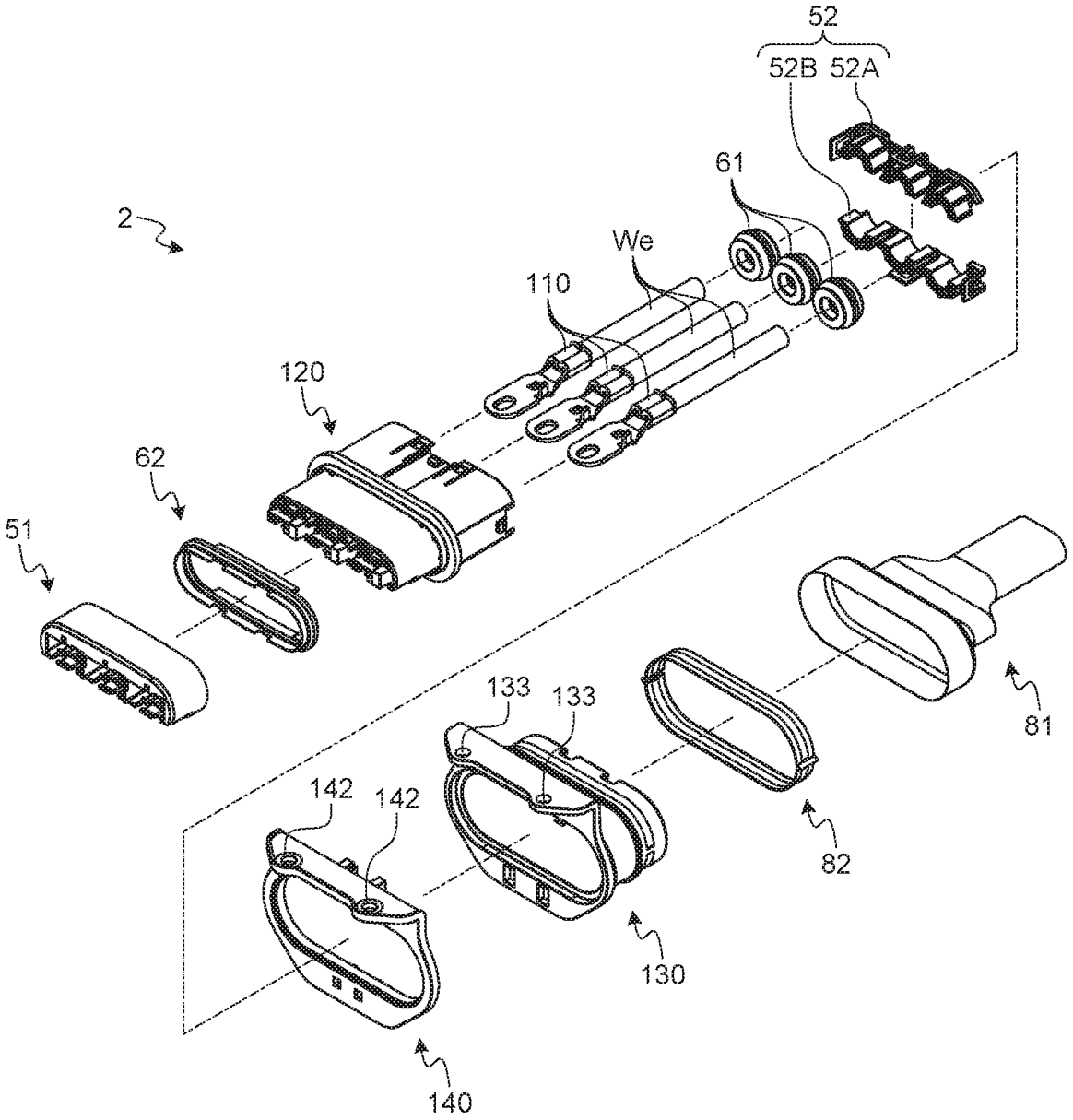
FIG. 15 is an exploded perspective view illustrating the connector of the modification.

Reference numeral 2 in FIGS. 10 to 15 denotes a connector of the present modification. The connector 2 is electrically connected to the counterpart terminal metal fitting of the counterpart device 500 to achieve electrical connection between the counterpart device 500 and the device connected to the electric wire We (FIGS. 10 to 12) similarly to the connector 1 of the above embodiment. The connector 2 includes a terminal metal fitting 110, a housing 120, a shield shell 130, and an interposed member 140 (FIGS. 12, 14, and 15).

The terminal metal fitting 110 described here is the same element as the terminal metal fitting 10 described in the embodiment. The housing 120 described here is also the same element as the housing 20 described in the embodiment. Thus, in the following, the description of the terminal metal fitting 110 and the housing 120 is omitted by assigning the same reference numerals as those of the terminal metal fitting 10 of the embodiment to the terminal metal fitting 110 of the present modification, and the same reference numerals as those of the housing 20 of the embodiment to the housing 120 of the present modification. Those assigned the same reference numerals as those of the embodiment other than the above elements are also considered to be the same elements as those described in the embodiment, and the description thereof is omitted.

In the present modification, the shield shell 130 is also formed from a metal material (e.g., stainless steel) so as to prevent noise intrusion from the outside. The shield shell 130 has an accommodation body 131 similar to the accommodation body 31 of the shield shell 30 of the embodiment, and a flange 132 similar to the flange 32 of the shield shell 30 (FIGS. 10 to 14 and 16 to 18).

The shield shell 130 also has a fixed part 133 to be fixed to the case 501 (FIGS. 10 to 14 and 16 to 18). The shield shell 130 is mounted on the orthogonal wall surface 501*c* by the fixed part 133 to be fixed to the case 501 similarly to the shield shell 30 of the embodiment. Thus, the shield shell 130 has a plate body 134 similar to the plate body 34 of the shield shell 30 of the embodiment (FIGS. 10 to 14 and 16 to 18). The fixed part 133 is provided at two positions in the plate body 134. The fixed part 133 of the present modification is formed as a circular through hole coaxial with the male threaded member B and the fixing part 501*d* as the female threaded part in the plate body 134. The male threaded member B is inserted through the fixed part 133.

Figure 16:
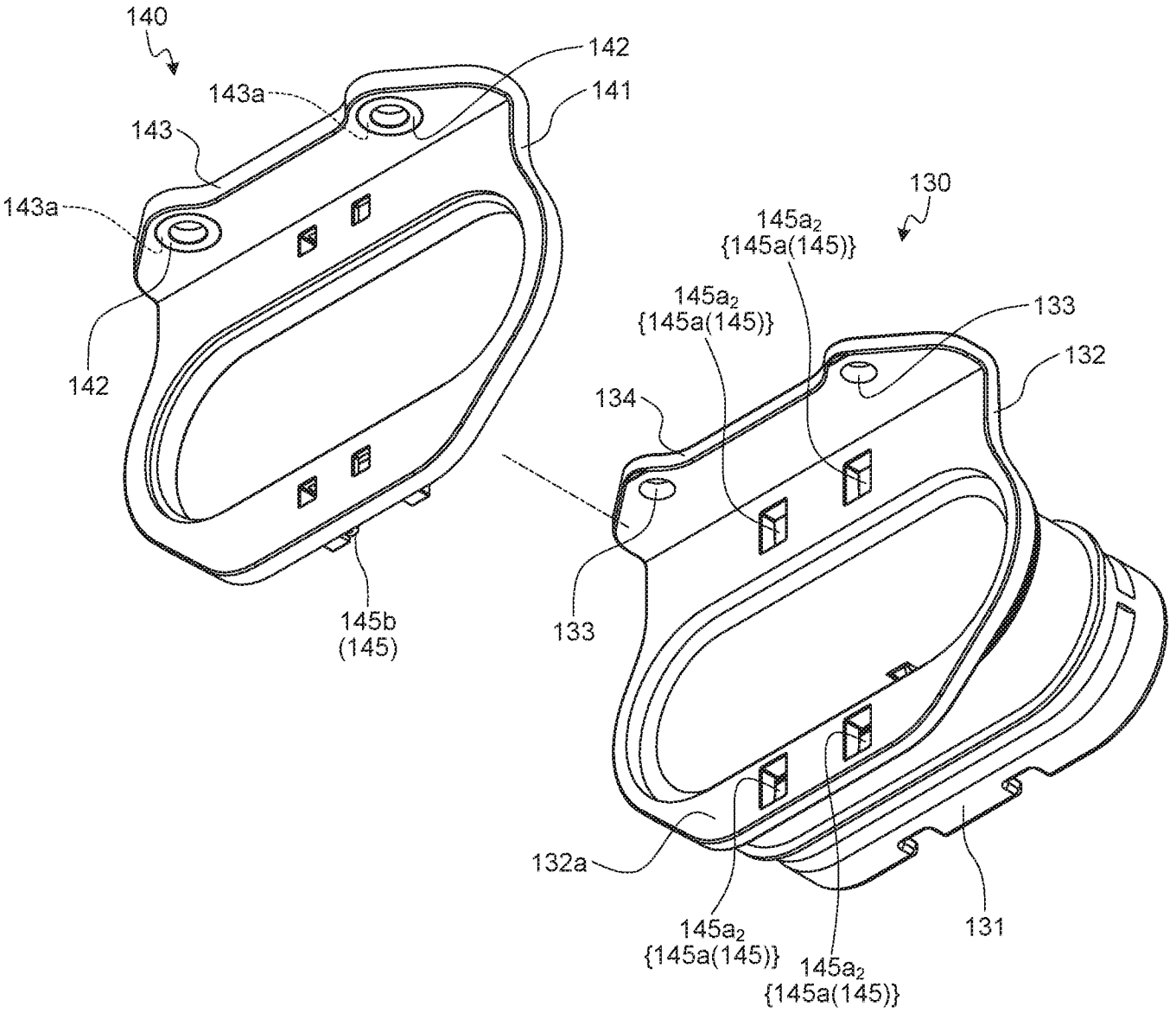
FIG. 16 is an exploded perspective view illustrating a shield shell and an interposed member of the modification before assembled.
Figure 17:
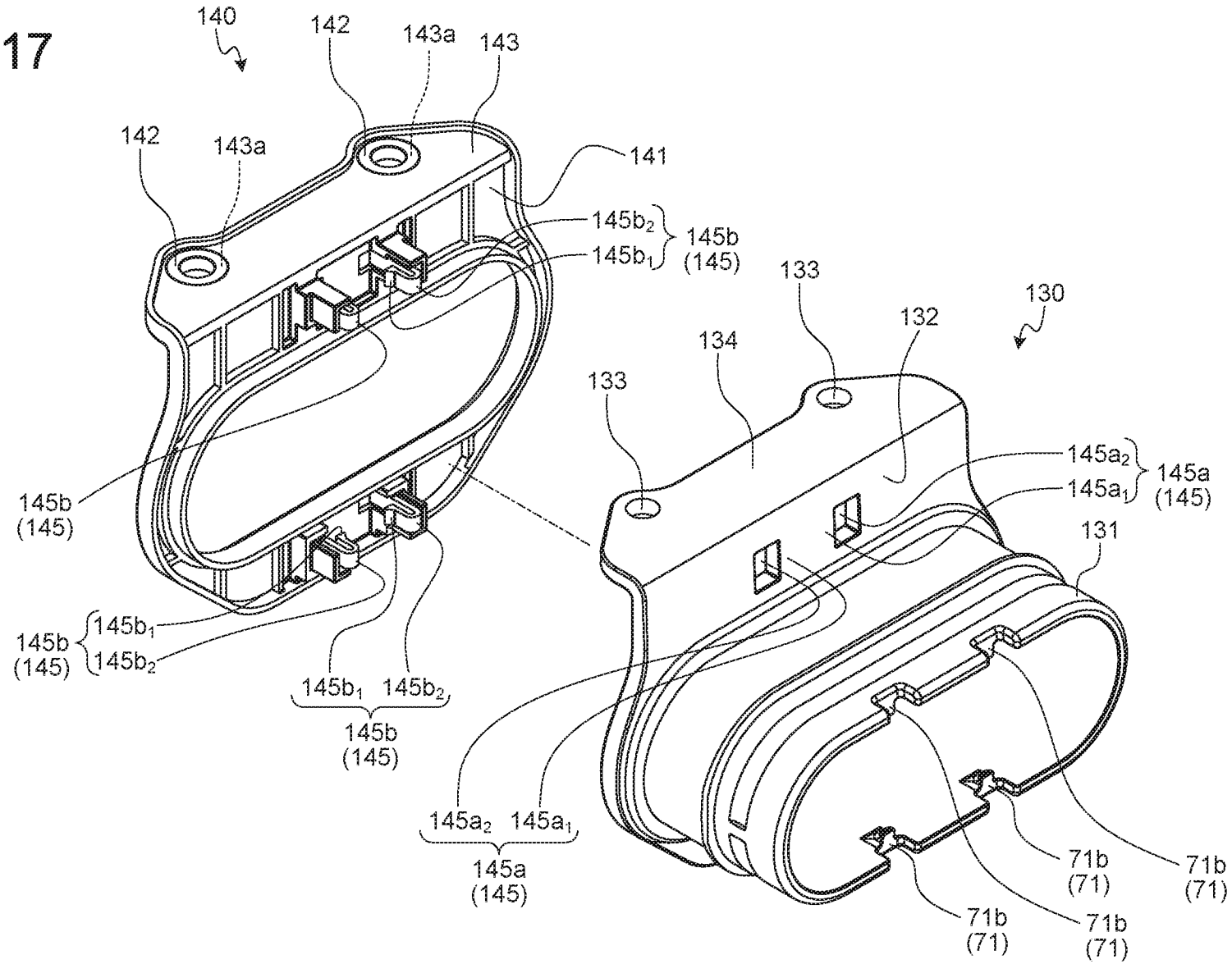
FIG. 17 is an exploded perspective view of the shield shell and the interposed member of the modification before assembled as viewed from another angle.

The interposed member 140 is interposed between the flange 132 of the shield shell 130 and the annular surface 501$b_1$ in the outer wall surface 501*b* of the case 501 to be sandwiched between an annular flat surface 132*a* of the flange 132 and the annular surface 501$b_1$ (FIGS. 10 to 13 and 16) similarly to the interposed member 40 of the embodiment. The interposed member 140 has an annular body 141 formed in an annular and planar shape extending along a circumferential direction of the flange 132 and the annular surface 501$b_1$ (FIGS. 14, 16, and 17). The annular body 141 of the interposed member 140 is interposed between the flange 132 and the annular surface 501$b_1$ to be sandwiched between the annular flat surface 132*a* of the flange 132 and the annular surface 501$b_1$. The annular body 141 in this example is formed in a shape equal to that of the interposed member 40 of the embodiment. One of flat surfaces of the annular body 141 is brought into contact with the annular flat surface 132*a* of the flange 132, and the other of the flat surfaces with the annular surface 501$b_1$ of the case 501.

The interposed member 140 is fixed to the shield shell 130 by a locking mechanism 145 formed between the interposed member 140 and the shield shell 130 (FIGS. 10 to 13 and 16 to 18). The locking mechanism 145 includes a first engagement body 145*a* disposed in the flange 132 of the shield shell 130, and a second engagement body 145*b* disposed in the annular body 141 of the interposed member 140. By engaging the first engagement body 145*a* and the second engagement body 145*b* together with the annular flat surface 132*a* of the flange 132 and the flat surface of the annular body 141 contacting with each other, the locking mechanism 145 fixes the shield shell 130 and the interposed member 140 to each other in the contacting state.

Figure 18:
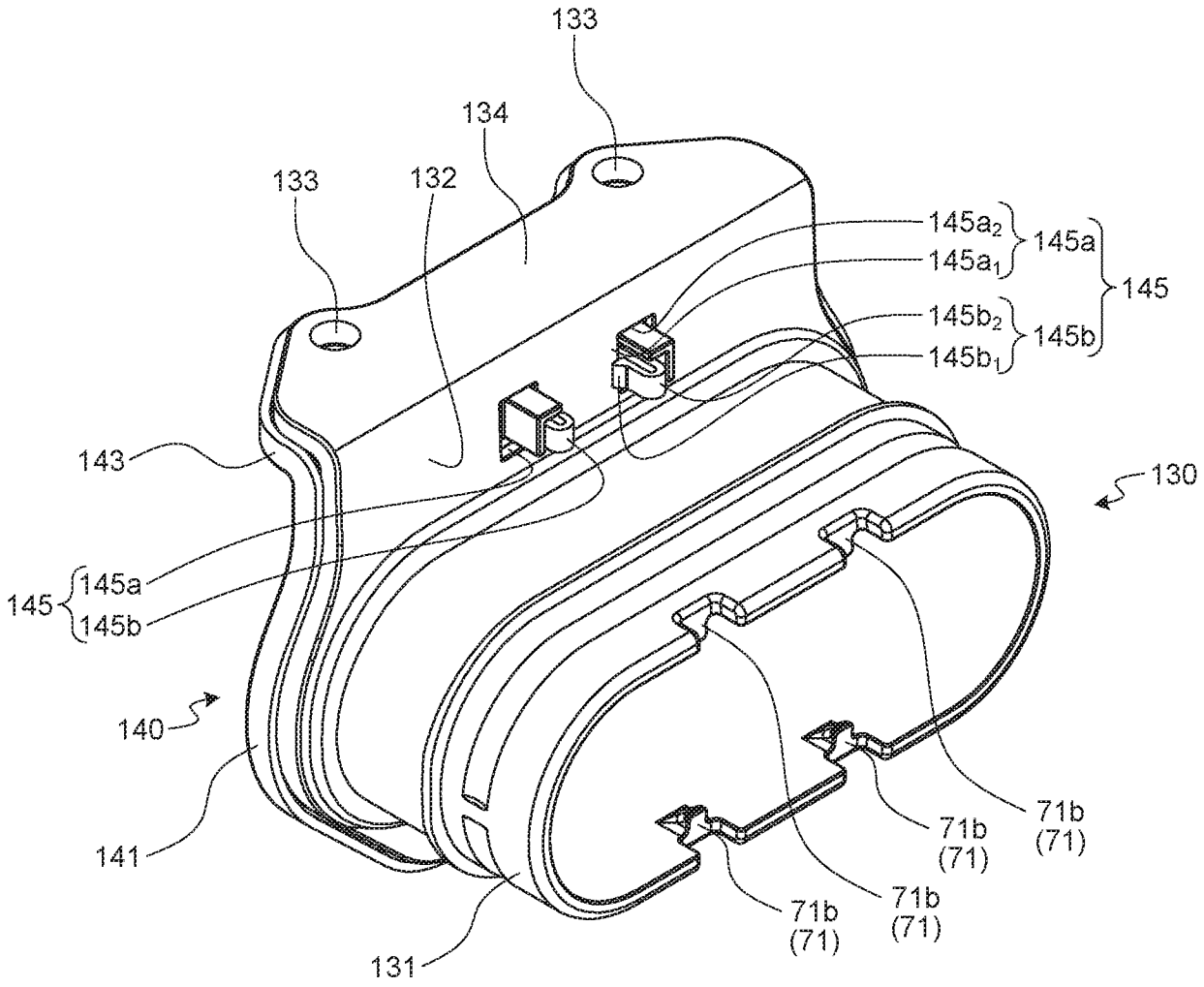
FIG. 18 is a perspective view illustrating the shield shell and the interposed member of the modification after assembled.

For example, a claw is provided in one of the first engagement body 145*a* and the second engagement body 145*b*, and a claw locking wall is provided in the other. In this example, the first engagement body 145*a* has a claw locking wall 145$a_1$, and the second engagement body 145*b* has a claw 145$b_1$ (FIGS. 17 and 18). The first engagement body 145*a* has a through hole 145$a_2$ formed in the flange 132, and a peripheral edge of the through hole 145$a_2$ is used as the claw locking wall 145$a_1$ (FIGS. 17 and 18). The second engagement body 145*b* also has a U-shaped cantilever flexible plate 145$b_2$ in which the claw 145$b_1$ is disposed on a free end side (FIGS. 17 and 18). For the locking mechanism 145, the claw 145$b_1$ together with the flexible plate 145$b_2$ is inserted into the through hole 145$a_2$ while the flexible plate 145$b_2$ is being bent. When the bend of the flexible plate 145$b_2$ is eliminated, the claw 145$b_1$ and the claw locking wall 145$a_1$ are opposed to each other. The claw 145$b_1$ of the locking mechanism 145 is thereby locked to the claw locking wall 145$a_1$ so as to maintain the contacting state between the annular flat surface 132*a* of the flange 132 and the flat surface of the annular body 141.

The locking mechanism 145 is provided at four positions between the shield shell 130 and the interposed member 140.

The interposed member 140 is formed from a resin material similarly to the interposed member 40 of the embodiment. The interposed member 140 thereby prevents contact between the shield shell 130 and the case 501 in the connector 2 similarly to the connector 1 of the embodiment. In the connector 2, when the shield shell 130 and the case 501 are formed from metal materials having different ionization tendencies, a potential difference generated by contact between metals is eliminated between the shield shell 130 and the case 501. This prevents the occurrence of corrosion in one of the shield shell 130 and the case 501 made of a metal material having a larger ionization tendency (the case 501 in this modification).

The interposed member 140 of the present modification is formed from an insulating synthetic resin material. Thus, the connector 2 cannot achieve electrical connection between the shield shell 130 and the case 501 via the annular body 141 of the interposed member 140 as in the connector 1 of the embodiment. The interposed member 140 of the present modification includes a conductive member 142 having electrical conductivity to the shield shell 130 and the case 501. The conductive member 142 achieves electrical connection between the shield shell 130 and the case 501 (FIGS. 12 and 15 to 17). The conductive member 142 is interposed between the fixed part 133 of the shield shell 130 and the fixing part 501*d* as the female threaded part, of the case 501. Thus, the conductive member 142 is provided at two positions.

The interposed member 140 of the present modification has a plate body 143 orthogonally connected to the annular body 141 to be interposed between the plate body 134 of the shield shell 130 and the orthogonal wall surface 501*c* of the case 501 (FIGS. 10 to 14 and 16 to 18). The conductive member 142 in this example is disposed in the plate body 143. The conductive member 142 is formed as, for example, a cylindrical collar member arranged coaxially with the fixed part 133 as the through hole and the fixing part 501*d* as the female threaded part. A through hole 143*a* into which the conductive member 142 is coaxially fitted is formed in the plate body 143 (FIGS. 16 and 17). The conductive member 142 is coaxially fitted into the through hole 143*a*, and the opposite ends of the conductive member 142 in the cylinder-axis direction thereof are protruded from the plate body 143. One of annular end surfaces of the conductive member 142 thereby abuts against a rim of the fixed part 133 of the plate body 134 of the shield shell 130, and the other of the annular end surfaces against the orthogonal wall surface 501*c* of the case 501. Thus, the conductive member 142 can be electrically connected to the shield shell 130 and the case 501.

The conductive member 142 is formed from, for example, a metal material. In this case, the conductive member 142 is configured as follows in accordance with one of the shield shell 130 and the case 501 made of a metal material having a larger ionization tendency.

For example, the conductive member 142 is preferably formed from a metal material having an ionization tendency equal or substantially equal to that of a metal material having a larger ionization tendency, out of the metal materials of the shield shell 130 and the case 501. Thus, a potential difference is reduced between the conductive member 142 and the one made of the metal material having a larger ionization tendency in the connector 2. This prevents the occurrence of galvanic corrosion in the one made of the metal material having a larger ionization tendency. Moreover, when the male threaded member B is also formed from a metal material, the male threaded member B is preferably formed from a metal material having an ionization tendency equal or substantially equal to that of a metal material having a larger ionization tendency, out of the metal materials of the shield shell 130 and the case 501. Thus, a potential difference is reduced between the male threaded member B and the one made of the metal material having a larger ionization tendency in the connector 2. This prevents the occurrence of galvanic corrosion in the one made of the metal material having a larger ionization tendency. In this example, the case 501 has a larger ionization tendency than the shield shell 130. Thus, the conductive member 142 and the male threaded member B are formed from a metal material having an ionization tendency equal or substantially equal to that of the case 501.

Additionally, the conductive member 142 and the male threaded member B may not be formed from the metal material having an ionization tendency equal or substantially equal to that of a metal material having a larger ionization tendency, out of the metal materials of the shield shell 130 and the case 501 in some cases. In this case, the conductive member 142 and the male threaded member B are preferably given surface treatment using the metal material having an ionization tendency equal or substantially equal to that of a metal material having a larger ionization tendency, out of the shield shell 130 and the case 501. The potential difference is thereby also reduced between the conductive member 142 and the one made of the metal material having a larger ionization tendency in the connector 2. This prevents the occurrence of galvanic corrosion in the one made of the metal material having a larger ionization tendency. Additionally, the potential difference is reduced between the male threaded member B and the one made of the metal material having a larger ionization tendency in the connector 2. This prevents the occurrence of galvanic corrosion in the one made of the metal material having a larger ionization tendency. In this example, the case 501 has a larger ionization tendency than the shield shell 130. Thus, the conductive member 142 and the male threaded member B are given surface treatment using the metal material having an ionization tendency equal or substantially equal to that of the case 501. For example, when the case 501 is formed from aluminum, the surfaces of the conductive member 142 and the male threaded member B may be given alumite treatment or plated with tin.

As described above, the connector 2 of the present modification can prevent the occurrence of corrosion between the shield shell 130 and the case 501 by interposing the interposed member 140 made of the resin material (insulating synthetic resin material) therebetween. That is, even when the shield shell 130 and the case 501 are formed from different metal materials (particularly metal materials having a large potential difference resulting from a difference in ionization tendency), the connector 2 can prevent the occurrence of corrosion in the one having a larger ionization tendency because of the interposed member 140 made of the resin material and interposed between the shield shell 130 and the case 501. Additionally, in the connector 2 of the present modification, the conductive member 142 attached to the plate body 143 of the interposed member 140 achieves electrical connection between the shield shell 130 and the case 501. In the connector 2, the conductive member 142 is interposed between the shield shell 130 and the case 501. Forming the conductive member 142 from the material described above, giving the surface treatment thereto as described above, or the like allows the occurrence of corrosion to be prevented in one of the shield shell 130 and the case 501 made of the metal material having a larger ionization tendency. As described above, the connector 2 of the present modification can improve its durability similarly to the connector 1 of the embodiment. The connector 2 of the present modification can improve the durability of the counterpart device 500 as well as improving its durability similarly to the connector 1 of the embodiment.

In the connector according to the present embodiment, the interposed member made of the resin material is interposed between the shield shell and the case. This prevents contact between the shield shell and the case. In the connector, when the shield shell and the case are formed from metal materials having different ionization tendencies, a potential difference generated by contact between metals is eliminated between the shield shell and the case. This prevents the occurrence of corrosion in one of the shield shell and the case made of the metal material having a larger ionization tendency. As described above, the connector according to the present invention can improve its durability. The connector according to the present invention can improve the durability of the counterpart device as well as improving its durability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal metal fitting that is physically and electrically connected to an end of an electric wire and is configured to be inserted into a connector insertion hole of a metal case of a counterpart device from an opening of the connector insertion hole and physically and electrically connected to a counterpart terminal metal fitting of the counterpart device;

a housing serving as an accommodation member made of an insulating material that accommodates the terminal metal fitting and the electric wire and leads the electric wire out of the housing, and includes a connector insertion part configured to be inserted into the connector insertion hole from the opening together with the terminal metal fitting;

a liquid seal member that is configured to seal a gap between the housing and a rim of the opening in the case;

a shield shell that is made of a metal material and includes a cylindrical accommodation body accommodating the housing therein, an annular flange configured to be opposed to an annular surface around the rim of the opening in an outer wall surface of the case, and a fixed part configured to be fixed to the case, the fixed part extends orthogonally from the flange; and an annular interposed member that is made of a resin material and is configured to be interposed between the flange and the annular surface to be sandwiched between the flange and the annular surface, wherein the fixed part includes a collar member configured to abut against the case, and the collar member is formed from a metal material having an ionization tendency equal to that of a metal material having a larger ionization tendency, out of metal materials of the shield shell and the case, or is given surface treatment using a metal material having an ionization tendency equal to that of a metal material having a larger ionization tendency, out of the metal materials of the shield shell and the case, or is coated with an insulating material on its surface.

2. The connector according to claim 1, wherein the interposed member is formed from a conductive rubber material.

3. The connector according to claim 1, wherein the interposed member is formed from an insulating synthetic resin material, and includes a conductive member having electrical conductivity and electrically connecting the shield shell and the case.

4. The connector according to claim 3, wherein the conductive member is formed from a metal material having an ionization tendency equal to that of a metal material having a larger ionization tendency, out of metal materials of the shield shell and the case, or is given surface treatment using a metal material having an ionization tendency equal to that of a metal material having a larger ionization tendency, out of the metal materials of the shield shell and the case.

* * * * *